US010847883B2

(12) United States Patent
Liao et al.

(10) Patent No.: US 10,847,883 B2
(45) Date of Patent: Nov. 24, 2020

(54) ENHANCED PRINTED CIRCUIT BOARD MONOPOLE ANTENNA

(71) Applicant: Power Wave Electronic Co .,Ltd., Taipei (TW)

(72) Inventors: Wen-Jiao Liao, Taipei (TW); Wei-Hong Tsai, Taipei (TW); Yun-Chan Tsai, Taipei (TW)

(73) Assignee: POWER WAVE ELECTRONIC CO., LTD., Taipei (TW)

( * ) Notice: Subject to any disclaimer, the term of this patent is extended or adjusted under 35 U.S.C. 154(b) by 0 days.

(21) Appl. No.: 16/727,860

(22) Filed: Dec. 26, 2019

(65) Prior Publication Data

US 2020/0136252 A1 Apr. 30, 2020

Related U.S. Application Data

(62) Division of application No. 15/614,593, filed on Jun. 5, 2017.

(51) Int. Cl.

| | |
|---|---|
| ***H01Q 5/357*** | (2015.01) |
| ***H01Q 9/42*** | (2006.01) |
| ***H01Q 1/38*** | (2006.01) |
| ***H01Q 1/24*** | (2006.01) |

(52) U.S. Cl.

CPC ..... *H01Q 5/357* (2015.01); *H01Q 1/243* (2013.01); *H01Q 1/38* (2013.01); *H01Q 9/42* (2013.01)

(58) Field of Classification Search

CPC ..... H01Q 1/243; H01Q 5/357; H01Q 9/42

See application file for complete search history.

(56) References Cited

U.S. PATENT DOCUMENTS

2002/0163473 A1* 11/2002 Koyama ..... H01Q 9/0421 343/718
2017/0141462 A1* 5/2017 Lin ..... H01Q 1/273
2018/0254556 A1* 9/2018 Li ..... H01Q 7/00

* cited by examiner

*Primary Examiner* — Dimary S Lopez Cruz
*Assistant Examiner* — Amal Patel
(74) *Attorney, Agent, or Firm* — Chun-Ming Shih; HDLS IPR Services

(57) ABSTRACT

An enhanced printed circuit board monopole antenna includes a baseplate, a signal feed-in unit, a first-radiation unit, a second-radiation unit and an auxiliary ground unit. The first-radiation unit and the second-radiation unit are arranged on a front side and an edge side of the baseplate. The auxiliary ground unit is arranged on the edge side and electrically connected to a first ground unit and a second ground unit on the baseplate. Adjusting the first-radiation unit controls 88 MHZ-60 GHZ frequency range impedance, resonant frequency, bandwidth and radiation effect. According to the frequency wave length (1λ, ½λ, ¼λ or ⅛λ) formed by the first-radiation unit and the second-radiation unit cooperating with each other, controlling 88 MHZ-60 GHZ frequency range achieves the predetermined target impedance, resonant frequency, bandwidth and radiation efficiency. The antenna radiation efficiency can be increased effectively.

5 Claims, 23 Drawing Sheets

ENHANCED PRINTED CIRCUIT BOARD MONOPOLE ANTENNA

CROSS-REFERENCE TO RELATED APPLICATION

This application is a divisional application of U.S. patent application Ser. No. 15/614,593, filed on Jun. 5, 2017, and entitled "ENHANCED PRINTED CIRCUIT BOARD MONOPOLE ANTENNA". The entire disclosures of the above application are all incorporated herein by reference.

BACKGROUND OF THE INVENTION

Field of the Invention

The present invention relates to an antenna, and especially relates to an enhanced printed circuit board monopole antenna which is used for data transmission.

Description of the Related Art

It is well known that the Bluetooth and WIFI system are arranged in the existing action-style electronic apparatus, so that the action-style electronic apparatus can perform the data transmission with another electronic apparatus or another action-style electronic apparatus.

With the continuous progress of the modern science and technology, a lot of action-style electronic apparatuses are slim and compact (for examples, the earphone or the portable mobile device). At this time, various antennas have to be arranged in the action-style electronic apparatus. When various antennas have to be arranged in the action-style electronic apparatus, the volumes of the circuit board or other components inside the action-style electronic apparatus have to be reduced. If the volumes of the circuit board or other components inside the action-style electronic apparatus cannot be reduced anyway, the volume of the antenna has to be reduced.

After the volume of the antenna is reduced, the antenna can be integrated with the circuit board or other components of the action-style electronic apparatus. But if the volume of the antenna is reduced, the receiving and transmitting performance of the antenna may be decreased, so that the action-style electronic apparatus cannot perform the data transmission with another electronic apparatus or another action-style electronic apparatus.

SUMMARY OF THE INVENTION

Therefore, the main object of the present invention is to solve the above-mentioned problems. The present invention provides a new enhanced printed circuit board monopole antenna to adjust the first-radiation unit to control 88 MHZ-60 GHZ frequency range impedance, resonant frequency, bandwidth and radiation effect. According to the frequency wave length (1λ, ½λ, ¼λ or ⅛λ) formed by the first-radiation unit and the second-radiation unit cooperating with each other, the present invention controls 88 MHZ-60 GHZ frequency range to achieve the predetermined target impedance, resonant frequency, bandwidth and radiation efficiency. The antenna radiation efficiency can be increased effectively.

In order to achieve the above-mentioned object, the present invention provides an enhanced printed circuit board monopole antenna comprising a baseplate, a signal feed-in unit, a first-radiation unit and a second-radiation unit. The baseplate comprises a front side, a back side and an edge side. A first ground unit is arranged on the front side. A second ground unit corresponding to the first ground unit is arranged on the back side of the baseplate. Moreover, the edge side comprises an edge front side, an edge aside side and an edge back side. The signal feed-in unit is arranged on the front side of the baseplate. A spacing is between the signal feed-in unit and the first ground unit. The first-radiation unit is arranged on the front side of the baseplate and is arranged at one side of the first ground unit and is electrically connected to the signal feed-in unit. The second-radiation unit is arranged on the edge front side of the edge side of the baseplate and is electrically connected to the first-radiation unit.

In an embodiment of the present invention, an opening in a U shape is arranged on the first ground unit. The spacing is between the opening and the signal feed-in unit.

In an embodiment of the present invention, the signal feed-in unit comprises a first signal feed-in line and a second signal feed-in line. The first signal feed-in line comprises a first endpoint and a second endpoint. The second signal feed-in line comprises a third endpoint and a fourth endpoint. A gap is between the second endpoint and the third endpoint.

In an embodiment of the present invention, the gap and the spacing form a matching circuit, or a coupling component or an inductance component is electrically connected to between the second endpoint and the third endpoint.

In an embodiment of the present invention, a length of the second-radiation unit is 5~300 mm.

In an embodiment of the present invention, the enhanced printed circuit board monopole antenna further comprises an auxiliary ground unit. The auxiliary ground unit is arranged on the edge aside side and the edge back side, and is electrically connected to the first ground unit and the second ground unit.

In an embodiment of the present invention, a plurality of breaches in arc shapes adjacent to each other are arranged at the edge front side and the edge aside side of the baseplate. The second-radiation unit is arranged on the front side of the baseplate, the edge front side, the edge aside side and the breaches at the edge front side and the edge aside side, and is electrically connected to the first-radiation unit.

In an embodiment of the present invention, a plurality of breaches in square shapes adjacent to each other are arranged at the edge front side and the edge aside side of the baseplate. The second-radiation unit is arranged on the front side of the baseplate, the edge front side, the edge aside side and the breaches at the edge front side and the edge aside side, and is electrically connected to the first-radiation unit.

In an embodiment of the present invention, the edge front side of the baseplate is paralleled. The second-radiation unit is arranged on the front side of the baseplate, the edge front side and the edge aside side, and is electrically connected to the first-radiation unit.

In an embodiment of the present invention, the edge front side is in an arc shape or is paralleled.

In an embodiment of the present invention, the first-radiation unit is in a square wave shape extended from a side of the baseplate and is electrically connected to the second-radiation unit.

In an embodiment of the present invention, an auxiliary-radiation unit in an L shape is extended from one side of the first-radiation unit. The auxiliary-radiation unit is composed of a first auxiliary-radiation line and a second auxiliary-radiation line. Namely, the auxiliary-radiation unit comprises the first auxiliary-radiation line and the second auxiliary-radiation line. One side of the first auxiliary-radiation line is electrically connected to the first-radiation unit. The other side of the first auxiliary-radiation line is extended to the edge aside side. The second auxiliary-radiation line is arranged on the edge aside side and is electrically connected to the first auxiliary-radiation line.

In order to achieve the above-mentioned object, the present invention provides another enhanced printed circuit board monopole antenna comprising a circle baseplate, a signal feed-in unit, a first-radiation unit and a second-radiation unit. The circle baseplate comprises a front side, a back side and a periphery side. A first ground unit is arranged on the front side. The first ground unit comprises a circle pattern layer and a fan-shaped pattern layer, wherein an area of the circle pattern layer and the fan-shaped pattern layer is less than an area of the front side of the circle baseplate. The fan-shaped pattern layer is extended to an edge of the front side. A second ground unit having the same shape with the first ground unit and corresponding to the first ground unit is arranged on the back side. The signal feed-in unit is arranged on the front side of the circle baseplate. A spacing is between the signal feed-in unit and the first ground unit. The first-radiation unit is arranged on the front side of the circle baseplate and is arranged at one side of the first ground unit and is electrically connected to the signal feed-in unit and has a specific length arranged along an edge of the front side of the circle baseplate. The second-radiation unit is arranged on the periphery side of the circle baseplate and is electrically connected to the first-radiation unit.

In an embodiment of the present invention, an opening in a U shape is arranged on the first ground unit. The spacing is between the opening and the signal feed-in unit.

In an embodiment of the present invention, the signal feed-in unit comprises a first signal feed-in line and a second signal feed-in line. The first signal feed-in line comprises a first endpoint and a second endpoint. The second signal feed-in line comprises a third endpoint and a fourth endpoint. A gap is between the second endpoint and the third endpoint.

In an embodiment of the present invention, the gap and the spacing form a matching circuit, or a coupling component or an inductance component is electrically connected to between the second endpoint and the third endpoint.

In an embodiment of the present invention, a specific length of the second-radiation unit is 5~300 mm.

DETAILED DESCRIPTION OF THE INVENTION

Figure 1:
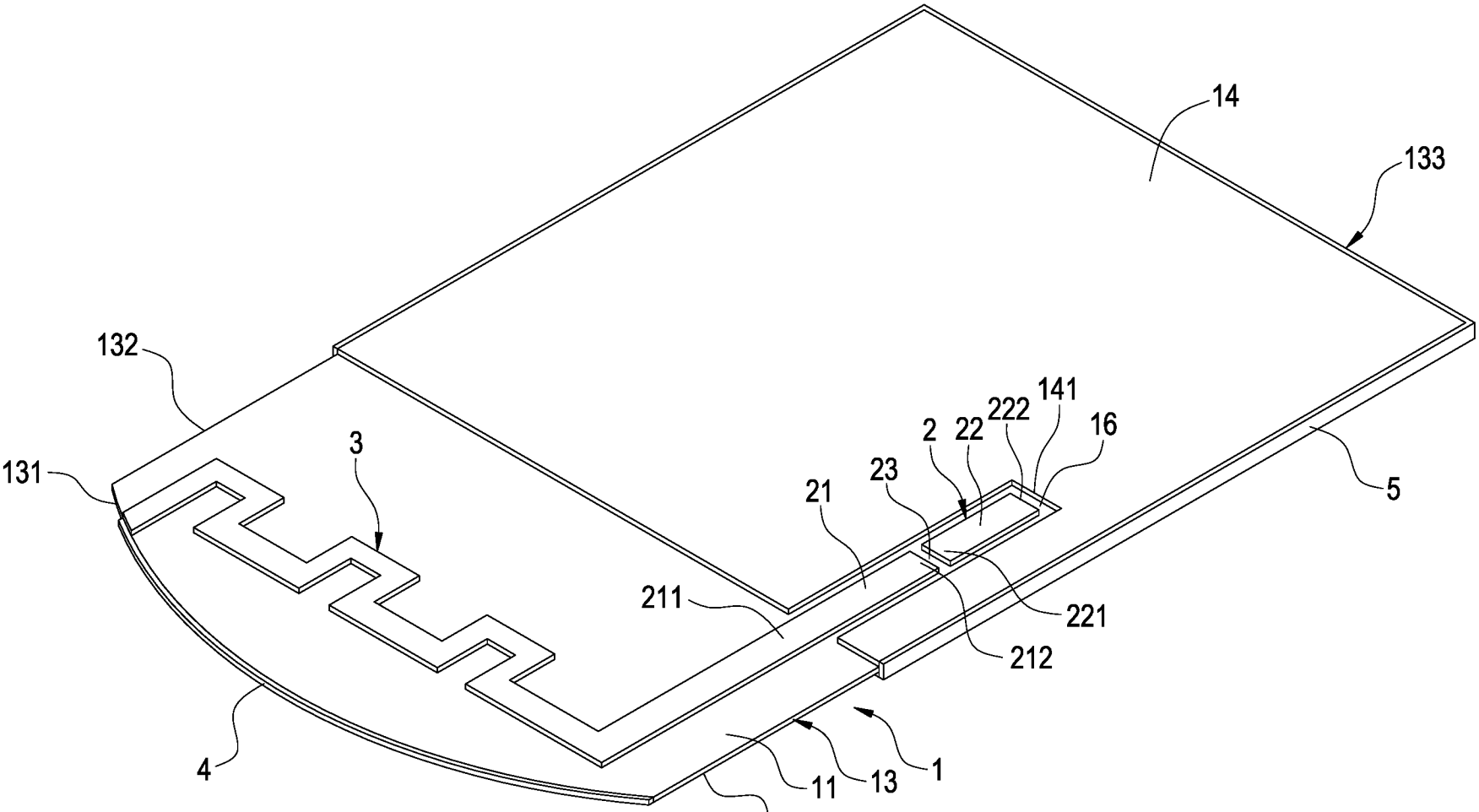
FIG. 1 shows a front view of the enhanced printed circuit board monopole antenna of the first embodiment of the present invention.
Figure 2:
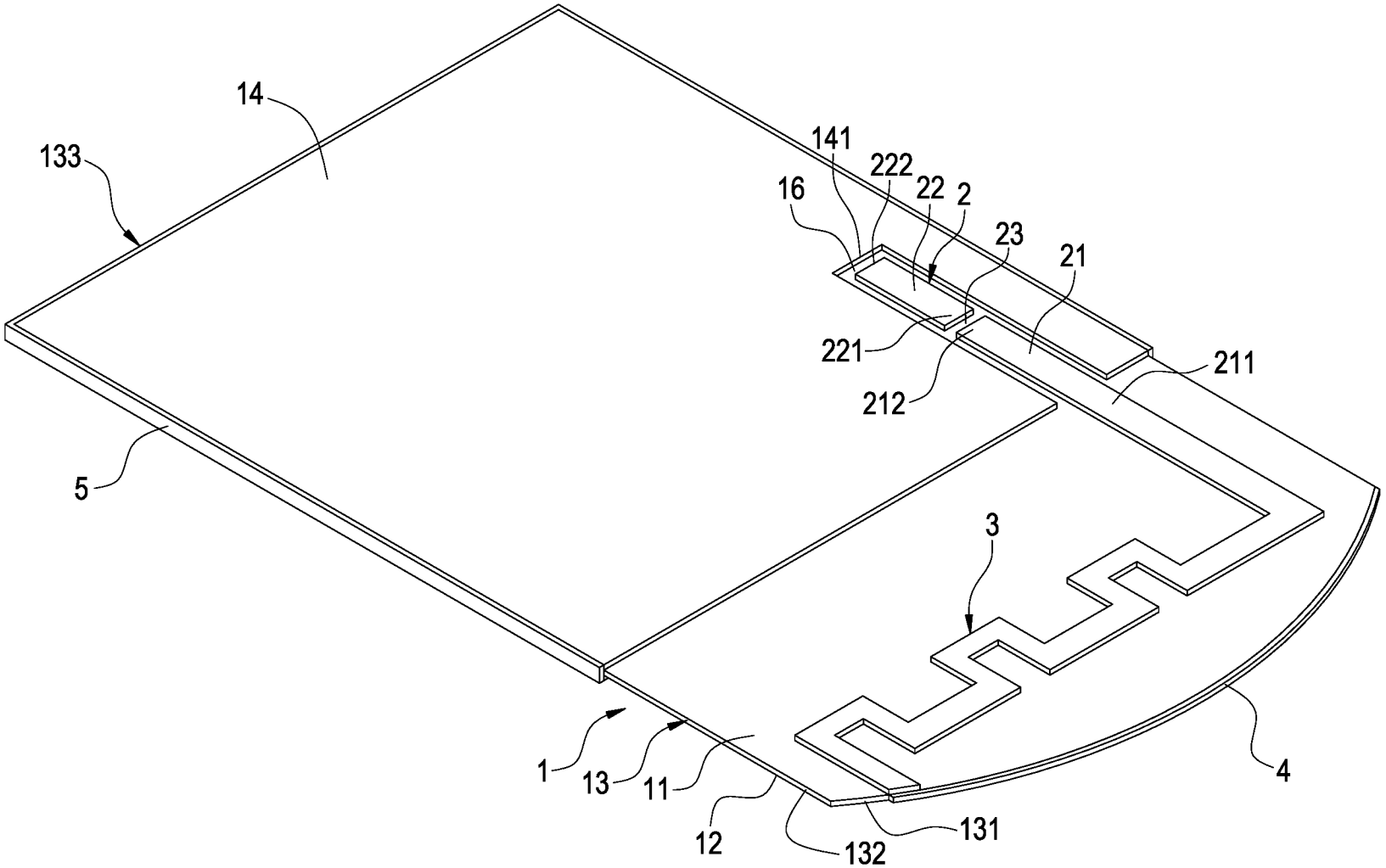
FIG. 2 shows another front view of the enhanced printed circuit board monopole antenna of the first embodiment of the present invention.
Figure 3:
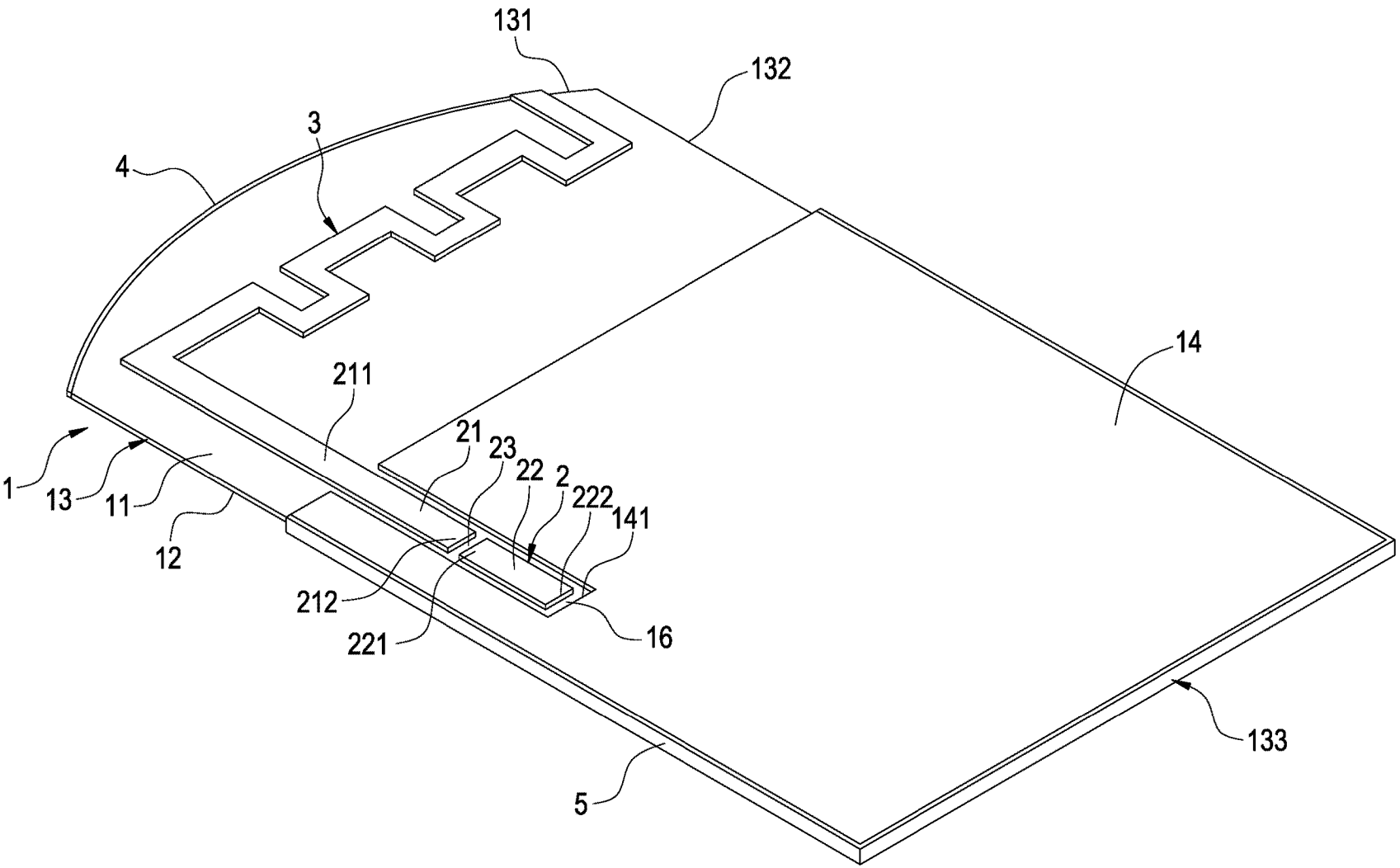
FIG. 3 shows a back view of the enhanced printed circuit board monopole antenna of the first embodiment of the present invention.
Figure 4:
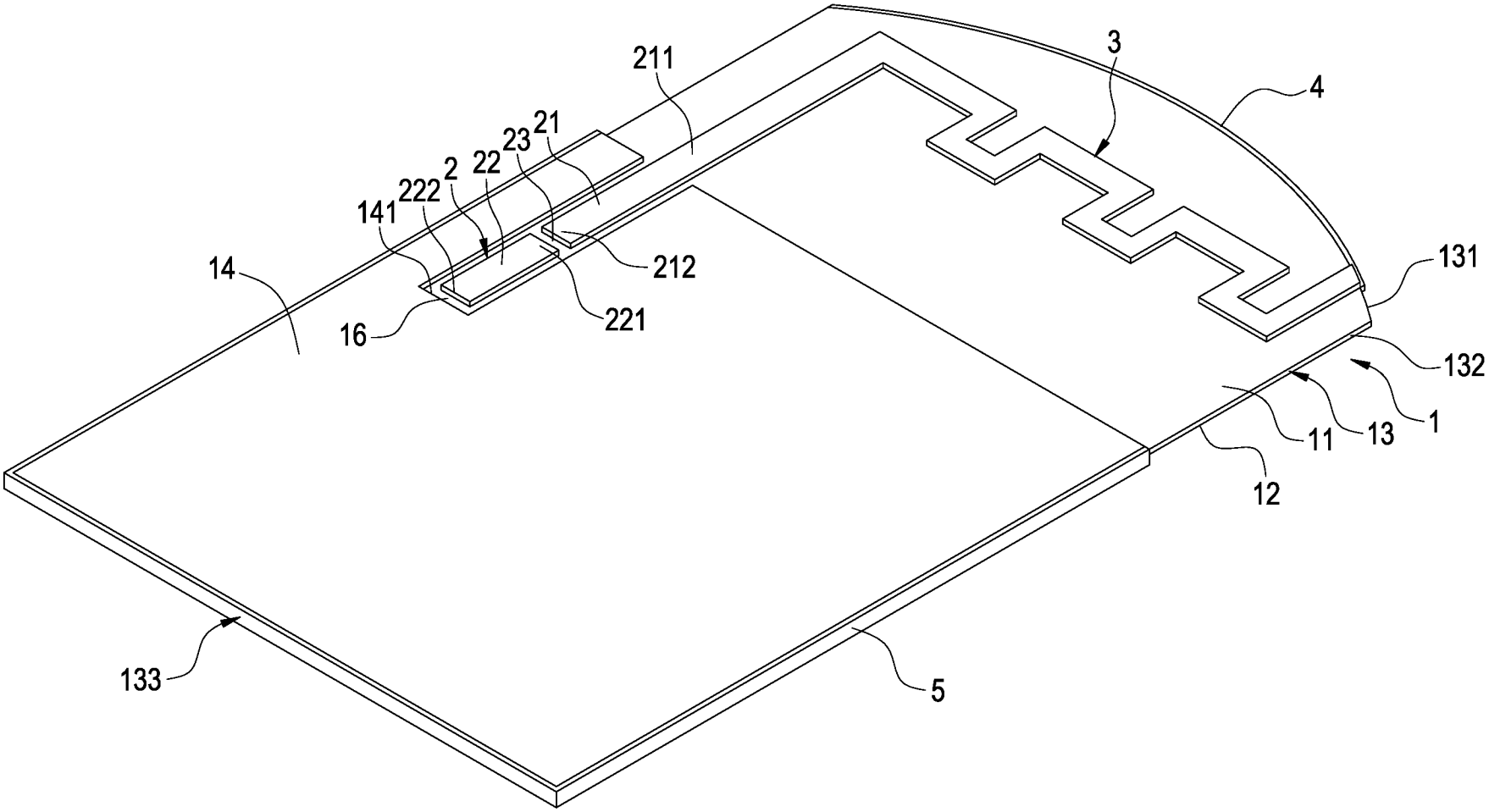
FIG. 4 shows another back view of the enhanced printed circuit board monopole antenna of the first embodiment of the present invention.
Figure 5:
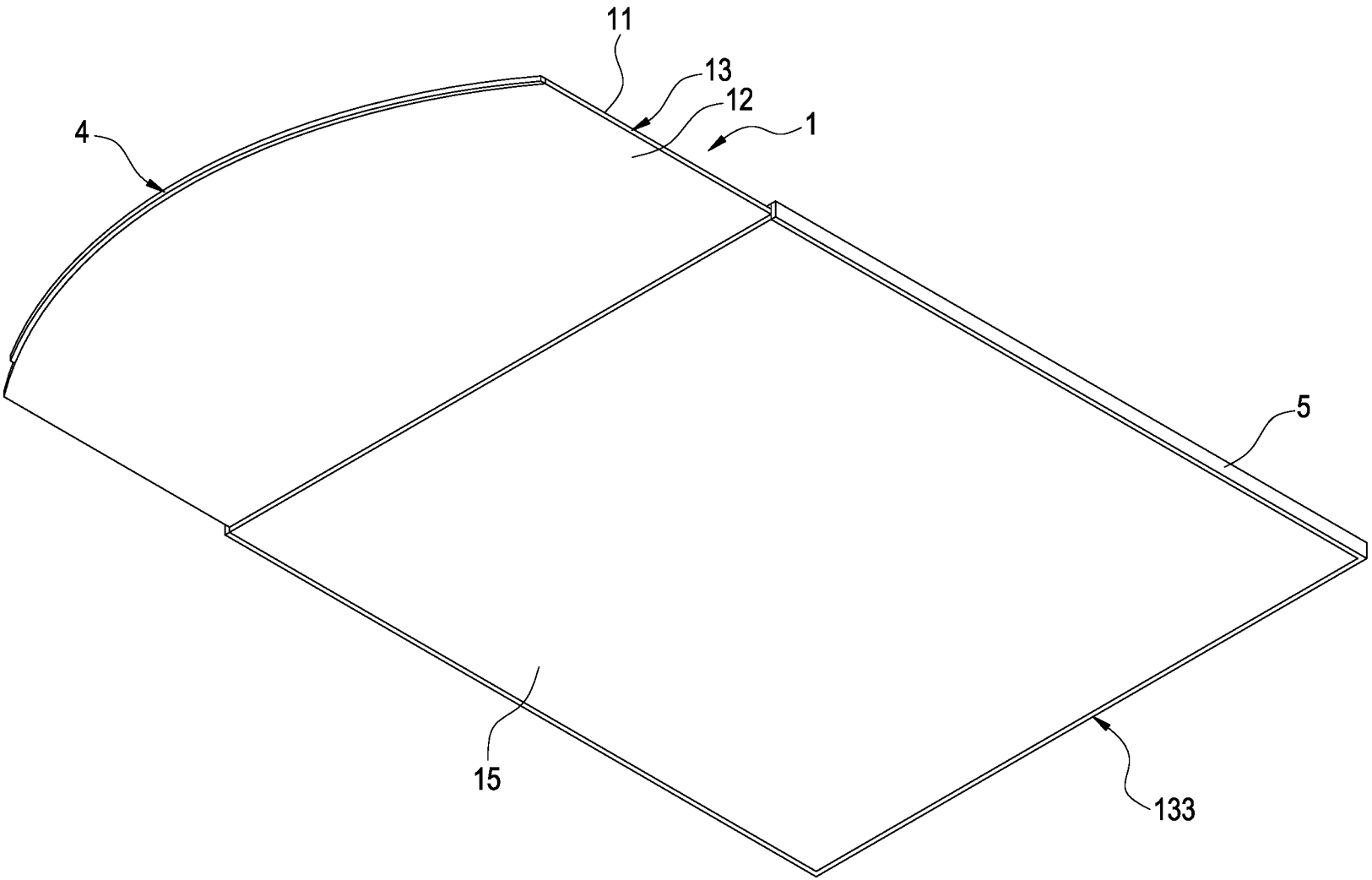
FIG. 5 shows a bottom view of the enhanced printed circuit board monopole antenna of the first embodiment of the present invention.

Now please refer to following detailed description and figures for the technical content of the present invention:

FIG. 1 shows a front view of the enhanced printed circuit board monopole antenna of the first embodiment of the present invention. FIG. 2 shows another front view of the enhanced printed circuit board monopole antenna of the first embodiment of the present invention. FIG. 3 shows a back view of the enhanced printed circuit board monopole antenna of the first embodiment of the present invention. FIG. 4 shows another back view of the enhanced printed circuit board monopole antenna of the first embodiment of the present invention. FIG. 5 shows a bottom view of the enhanced printed circuit board monopole antenna of the first embodiment of the present invention. As shown in FIGS. 1~5, an enhanced printed circuit board monopole antenna of the present invention comprises a baseplate 1, a signal feed-in unit 2, a first-radiation unit 3, a second-radiation unit 4 and an auxiliary ground unit 5.

The baseplate 1 comprises a front side 11, a back side 12 and an edge side 13. A first ground unit 14 is arranged on the front side 11. A second ground unit 15 is arranged on the back side 12. An opening 141 in a U shape is arranged on the first ground unit 14. The edge side 13 comprises an edge front side 131 in an arc shape, an edge aside side 132 and an edge back side 133. Namely, the enhanced printed circuit board monopole antenna of the present invention further comprises the first ground unit 14, the second ground unit 15 and the opening 141.

The signal feed-in unit 2 is arranged on the opening 141 of the first ground unit 14. A spacing 16 is between the signal feed-in unit 2 and the first ground unit 14. The signal feed-in unit 2 comprises a first signal feed-in line 21 and a second signal feed-in line 22. The first signal feed-in line 21 comprises a first endpoint 211 and a second endpoint 212. The second signal feed-in line 22 comprises a third endpoint 221 and a fourth endpoint 222. A gap 23 is between the second endpoint 212 and the third endpoint 221. The gap 23 forms a matching circuit, or a coupling component (not shown in the figures) or an inductance component (not shown in the figures) is electrically connected to between the second endpoint 212 and the third endpoint 221. Namely, the enhanced printed circuit board monopole antenna of the present invention further comprises the spacing 16 and the gap 23.

The first-radiation unit 3 is arranged on the front side 11 of the baseplate 1 and is arranged at one side of the first ground unit 14. The first-radiation unit 3 is electrically connected to the first endpoint 211 of the first signal feed-in line 21. The first-radiation unit 3 is in a square wave shape extended from a side of the baseplate 1 and is electrically connected to the second-radiation unit 4.

The second-radiation unit 4 is arranged on the edge front side 131 of the edge side 13 of the baseplate 1 and is electrically connected to the first-radiation unit 3. In the figures, a length of the second-radiation unit 4 is 5~300 mm.

The auxiliary ground unit 5 is arranged on the edge aside side 132 and the edge back side 133 of the edge side 13 of the baseplate 1, and is electrically connected to the first ground unit 14 and the second ground unit 15 on the baseplate 1 to enhance the ground and radiation efficiency.

The present invention adjusts the first-radiation unit 3 to control 88 MHZ-60 GHZ frequency range impedance, resonant frequency, bandwidth and radiation effect. At the same time, according to the frequency wave length (1λ, ½λ, ¼λ or ⅛λ) formed by the first-radiation unit 3 and the second-radiation unit 4 cooperating with each other, the present invention controls 88 MHZ-60 GHZ frequency range to achieve the predetermined target impedance, resonant frequency, bandwidth and radiation efficiency. The antenna efficiency can be increased effectively. Moreover, the second-radiation unit 4 can increase the antenna radiation efficiency, and the length of the second-radiation unit 4 is 5~300 mm.

Figure 6:
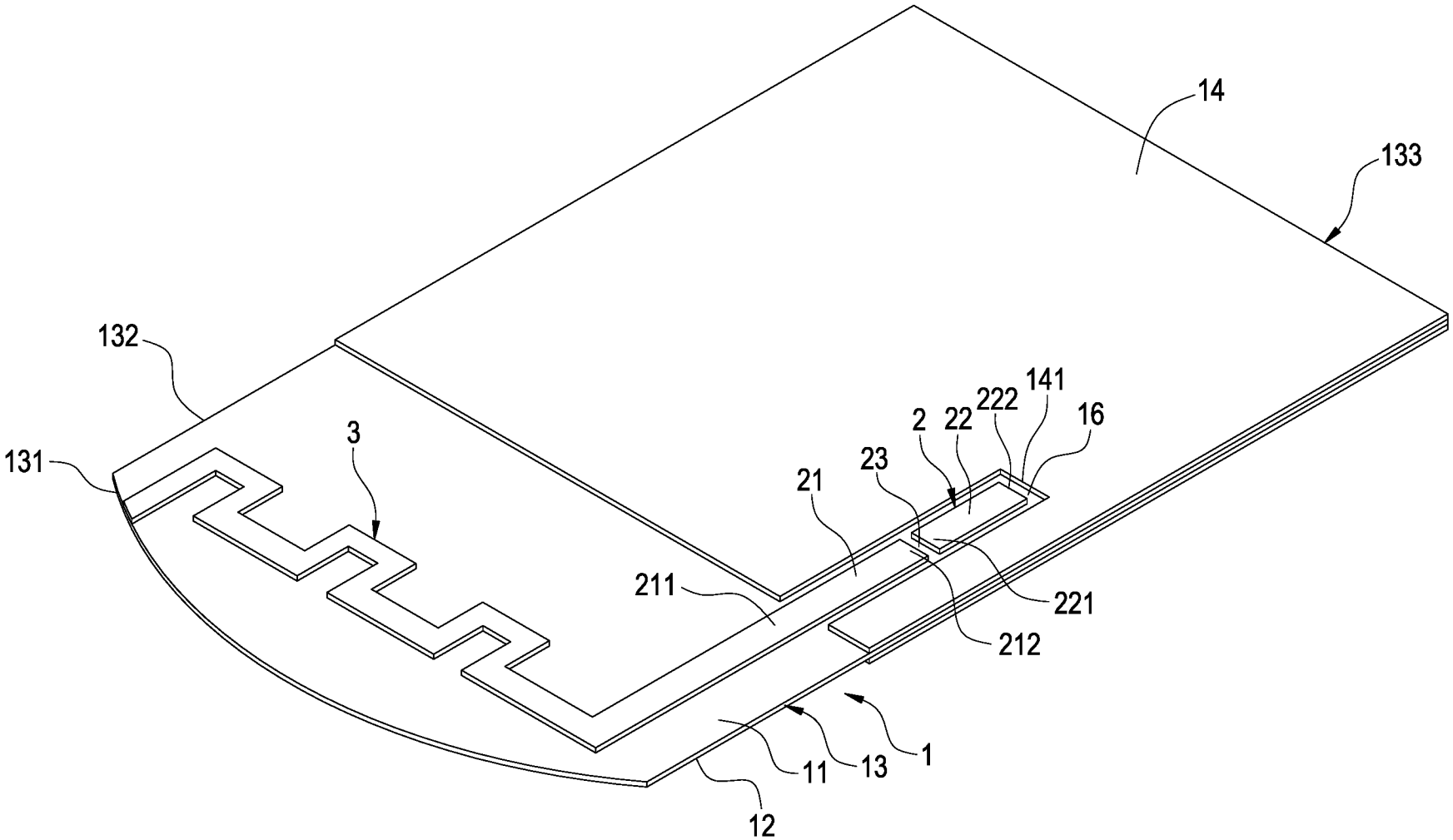
FIG. 6 shows the enhanced printed circuit board monopole antenna without the second-radiation unit of the first embodiment of the present invention.
Figure 7:
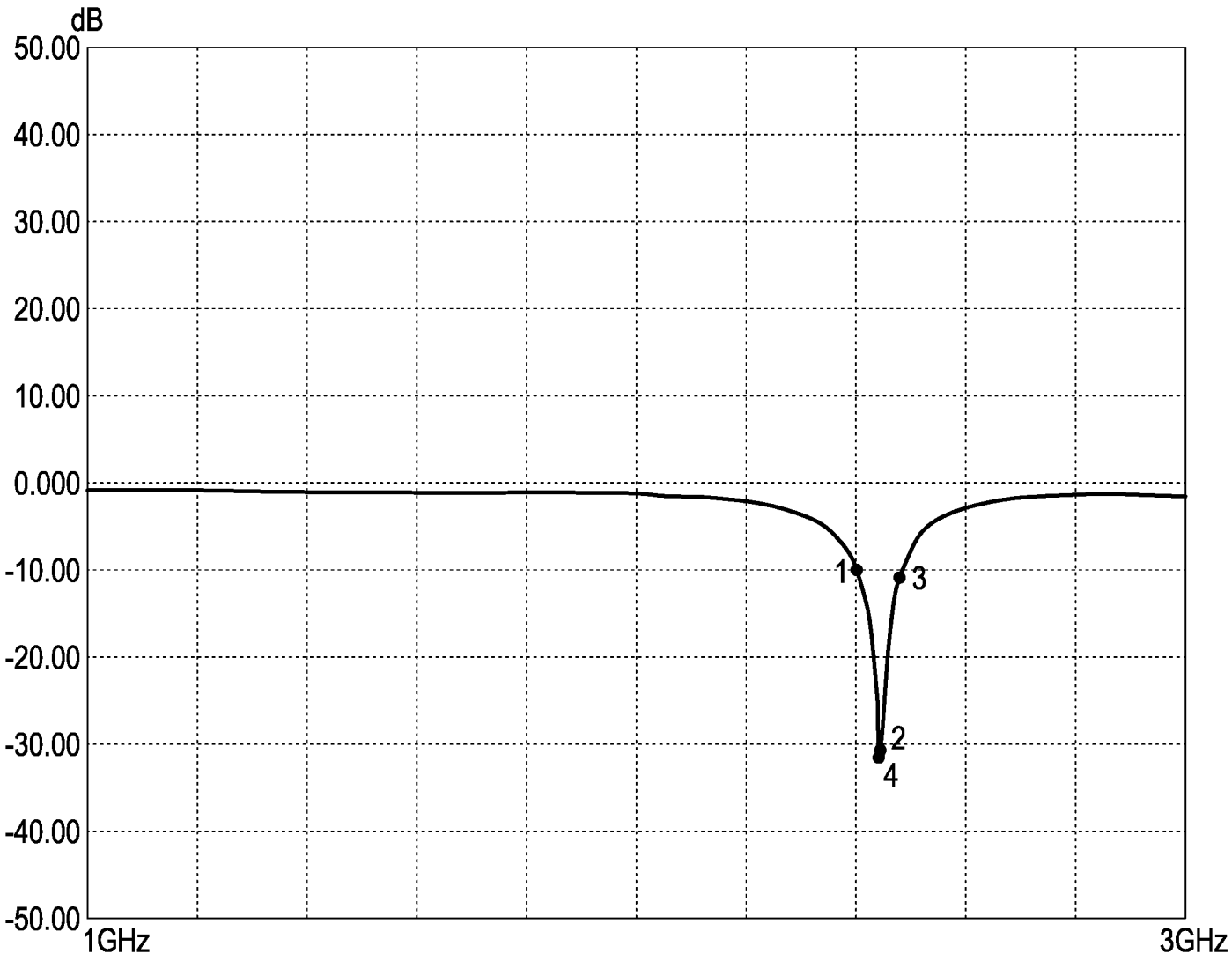
FIG. 7 shows a curve diagram of the reflection coefficient testing of the enhanced printed circuit board monopole antenna without the second-radiation unit at high frequencies of the first embodiment of the present invention.

FIG. 6 shows the enhanced printed circuit board monopole antenna without the second-radiation unit of the first embodiment of the present invention. FIG. 7 shows a curve diagram of the reflection coefficient testing of the enhanced printed circuit board monopole antenna without the second-radiation unit at high frequencies of the first embodiment of the present invention. As shown in the figures, when the enhanced printed circuit board monopole antenna without the second-radiation unit 4 is used, at frequency 2.400 GHZ is −9.5884 dB, at frequency 2.450 GHZ is −27.729 dB, at frequency 2.483 GHZ is −10.565 dB and at frequency 2.44625 GHZ is −32.961 dB. Therefore, for the design without the second-radiation unit 4, the first-radiation unit 3 cannot control 88 MHZ-60 GHZ frequency range to achieve the predetermined target impedance, resonant frequency, bandwidth and radiation efficiency. The antenna radiation efficiency cannot be increased efficiently, either.

Figure 8:
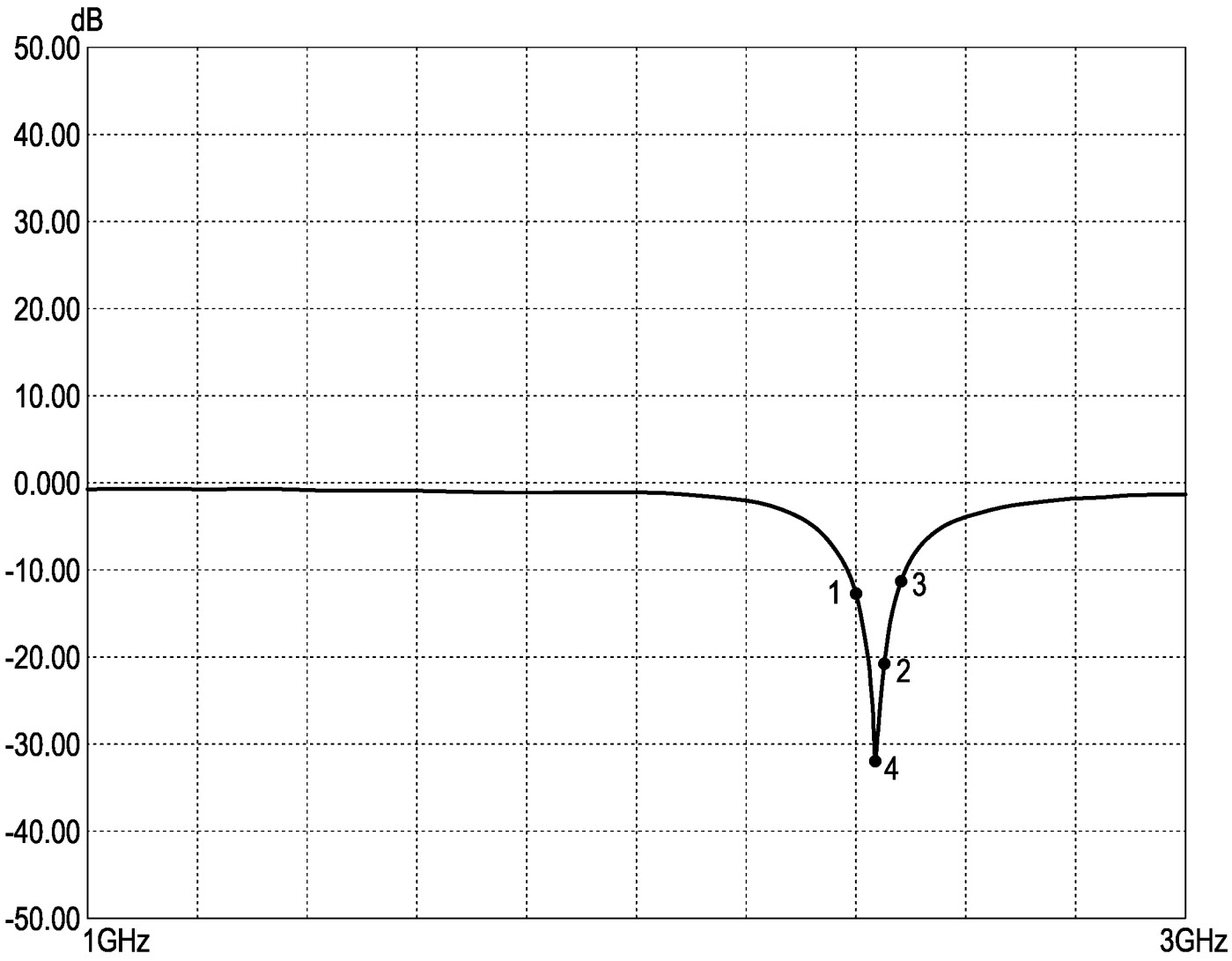
FIG. 8 shows a curve diagram of the reflection coefficient testing of the enhanced printed circuit board monopole antenna with the second-radiation unit at high frequencies of the first embodiment of the present invention.

FIG. 8 shows a curve diagram of the reflection coefficient testing of the enhanced printed circuit board monopole antenna with the second-radiation unit at high frequencies of the first embodiment of the present invention. Please refer to FIGS. 1~5 at the same time. As shown in FIG. 8, when the enhanced printed circuit board monopole antenna with the second-radiation unit 4 is used, at frequency 2.400 GHZ is −13.439 dB, at frequency 2.450 GHZ is −20.936 dB, at frequency 2.483 GHZ is −11.216 dB and at frequency 2.4436250 GHZ is −32.105 dB. Therefore, according to the frequency wave length (1λ, ½λ, ¼λ or ⅛λ) formed by the first-radiation unit 3 and the second-radiation unit 4 cooperating with each other, the present invention controls 88 MHZ-60 GHZ frequency range to achieve the predetermined target impedance, resonant frequency, bandwidth and radiation efficiency. The antenna radiation efficiency can be increased effectively.

Figure 9:
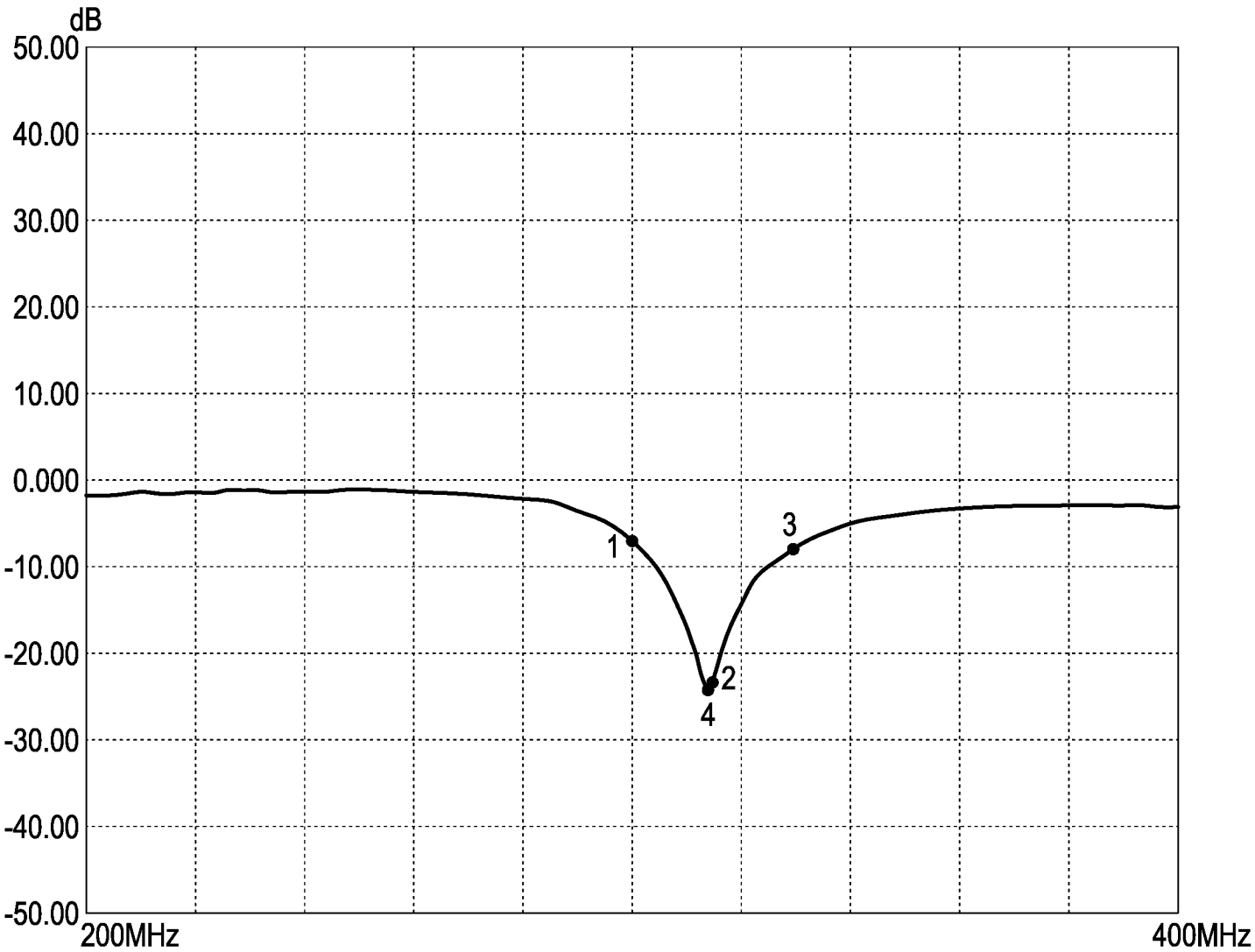
FIG. 9 shows a curve diagram of the reflection coefficient testing of the enhanced printed circuit board monopole antenna without the second-radiation unit at low frequencies of the first embodiment of the present invention.

FIG. 6 shows the enhanced printed circuit board monopole antenna without the second-radiation unit of the first embodiment of the present invention. FIG. 9 shows a curve diagram of the reflection coefficient testing of the enhanced printed circuit board monopole antenna without the second-radiation unit at low frequencies of the first embodiment of the present invention. As shown in FIG. 9, when the enhanced printed circuit board monopole antenna without the second-radiation unit 4 is used, at frequency 300.00000 MHZ is −6.9379 dB, at frequency 315.00000 MHZ is −23.394 dB, at frequency 330.00000 MHZ is −7.7355 dB and at frequency 314.00000 MHZ is −24.494 dB. Therefore, for the design without the second-radiation unit 4, the first-radiation unit 3 cannot control 88 MHZ-60 GHZ frequency range to achieve the predetermined target impedance, resonant frequency, bandwidth and radiation efficiency. The antenna radiation efficiency cannot be increased efficiently, either.

Figure 10:
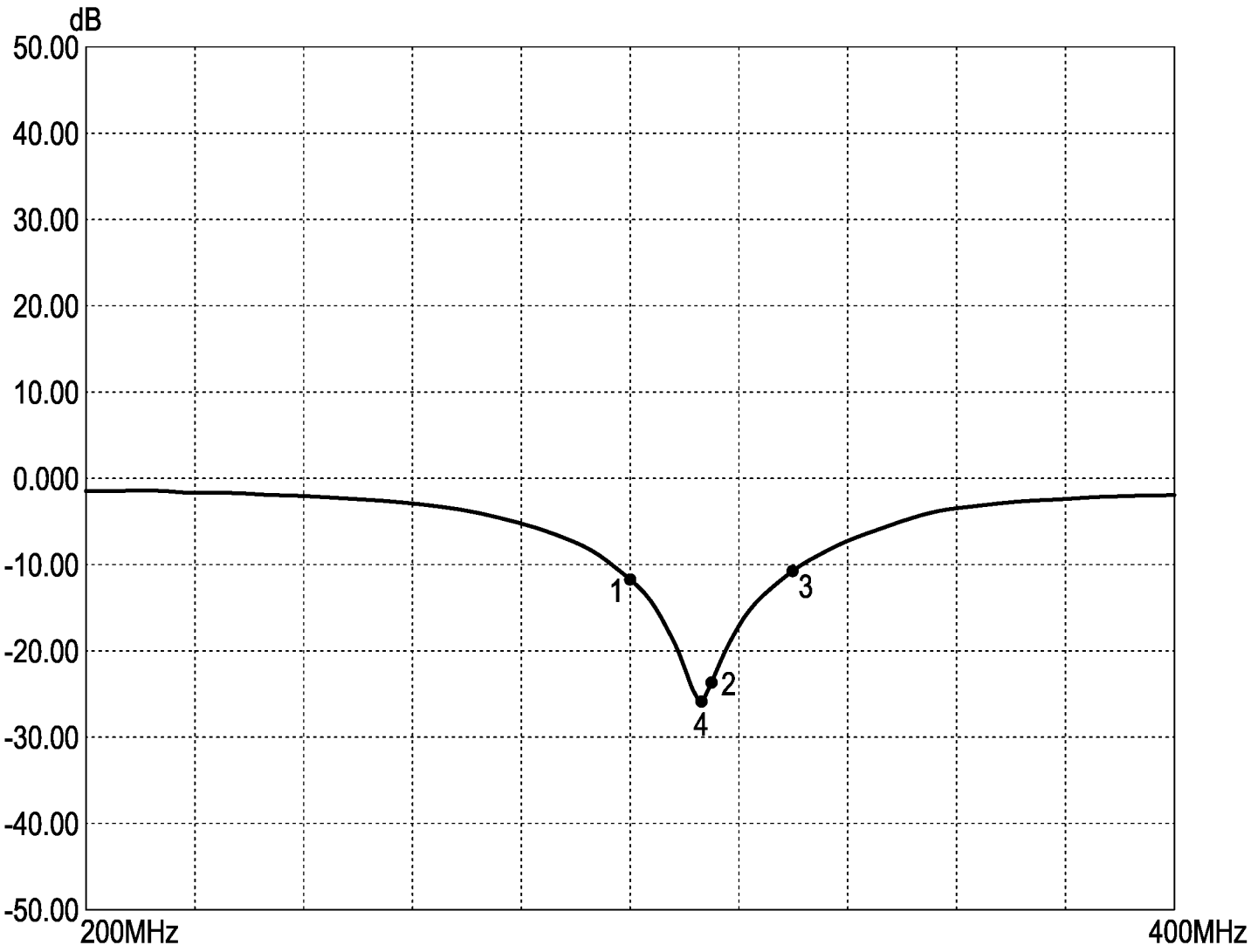
FIG. 10 shows a curve diagram of the reflection coefficient testing of the enhanced printed circuit board monopole antenna with the second-radiation unit at low frequencies of the first embodiment of the present invention.

FIG. 10 shows a curve diagram of the reflection coefficient testing of the enhanced printed circuit board monopole antenna with the second-radiation unit at low frequencies of the first embodiment of the present invention. Please refer to FIGS. 1-5 at the same time. As shown in FIG. 10, when the enhanced printed circuit board monopole antenna with the second-radiation unit 4 is used, at frequency 300.00000 MHZ is −11.764 dB, at frequency 315.00000 MHZ is −23.755 dB, at frequency 330.00000 MHZ is −10.703 dB and at frequency 313.00000 MHZ is −25.937 dB. Therefore, according to the frequency wave length (1λ, ½λ, ¼λ or ⅛λ) formed by the first-radiation unit 3 and the second-radiation unit 4 cooperating with each other, the present invention controls 88 MHZ-60 GHZ frequency range to achieve the predetermined target impedance, resonant frequency, bandwidth and radiation efficiency. The antenna radiation efficiency can be increased effectively.

Figure 11:
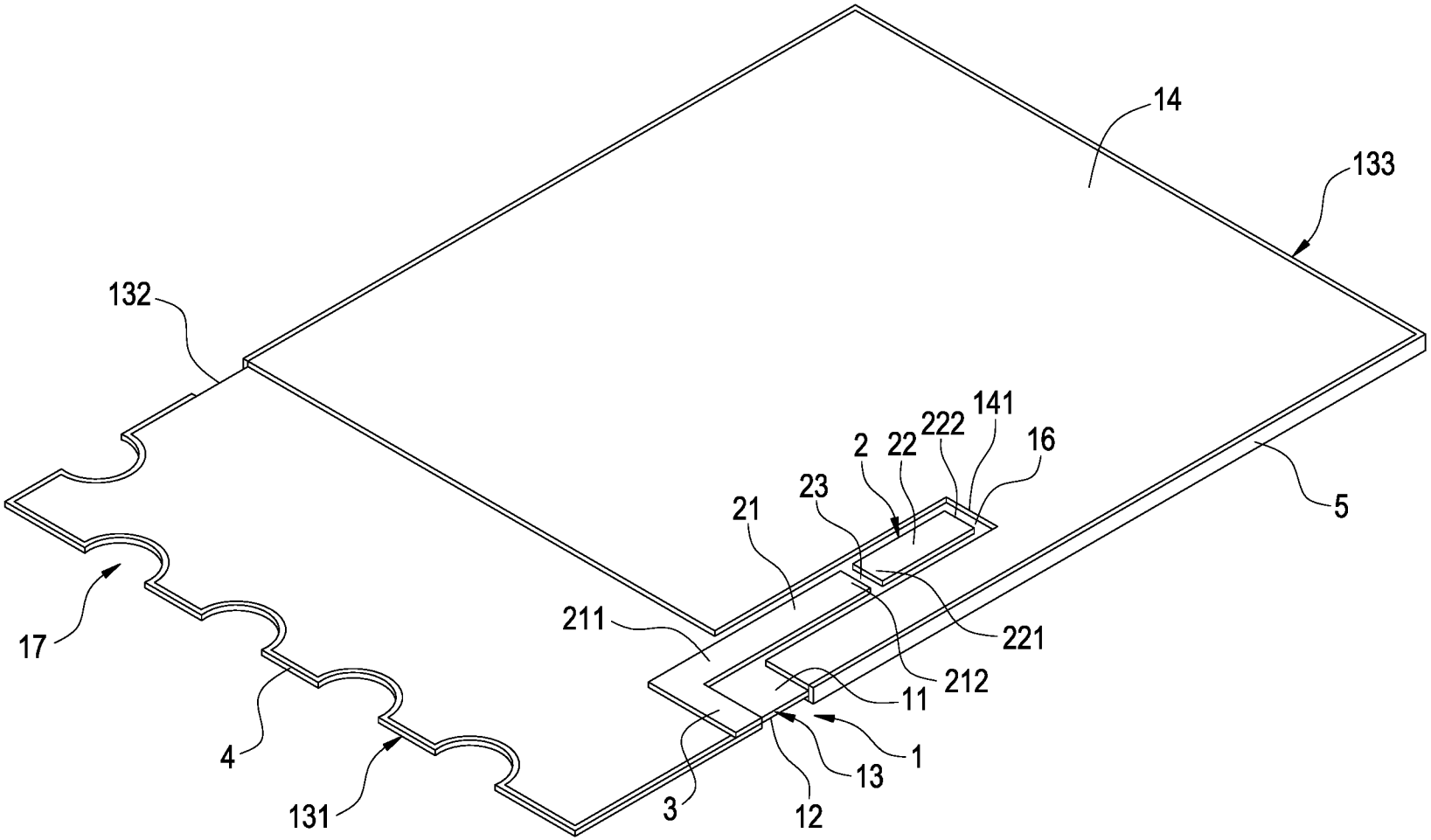
FIG. 11 shows a front view of the enhanced printed circuit board monopole antenna of the second embodiment of the present invention.

FIG. 11 shows a front view of the enhanced printed circuit board monopole antenna of the second embodiment of the present invention. As shown in FIG. 11, the second embodiment is much the same with the first embodiment. The differences are that a plurality of breaches 17 in arc shapes adjacent to each other are arranged at the edge front side 131 and the edge aside side 132 of the baseplate 1. Namely, the enhanced printed circuit board monopole antenna of the present invention further comprises the breaches 17. The second-radiation unit 4 is arranged on the front side 11 of the baseplate 1, the edge front side 131, the edge aside side 132 and the breaches 17 at the edge front side 131 and the edge aside side 132, and is electrically connected to the first-radiation unit 3.

Figure 12:
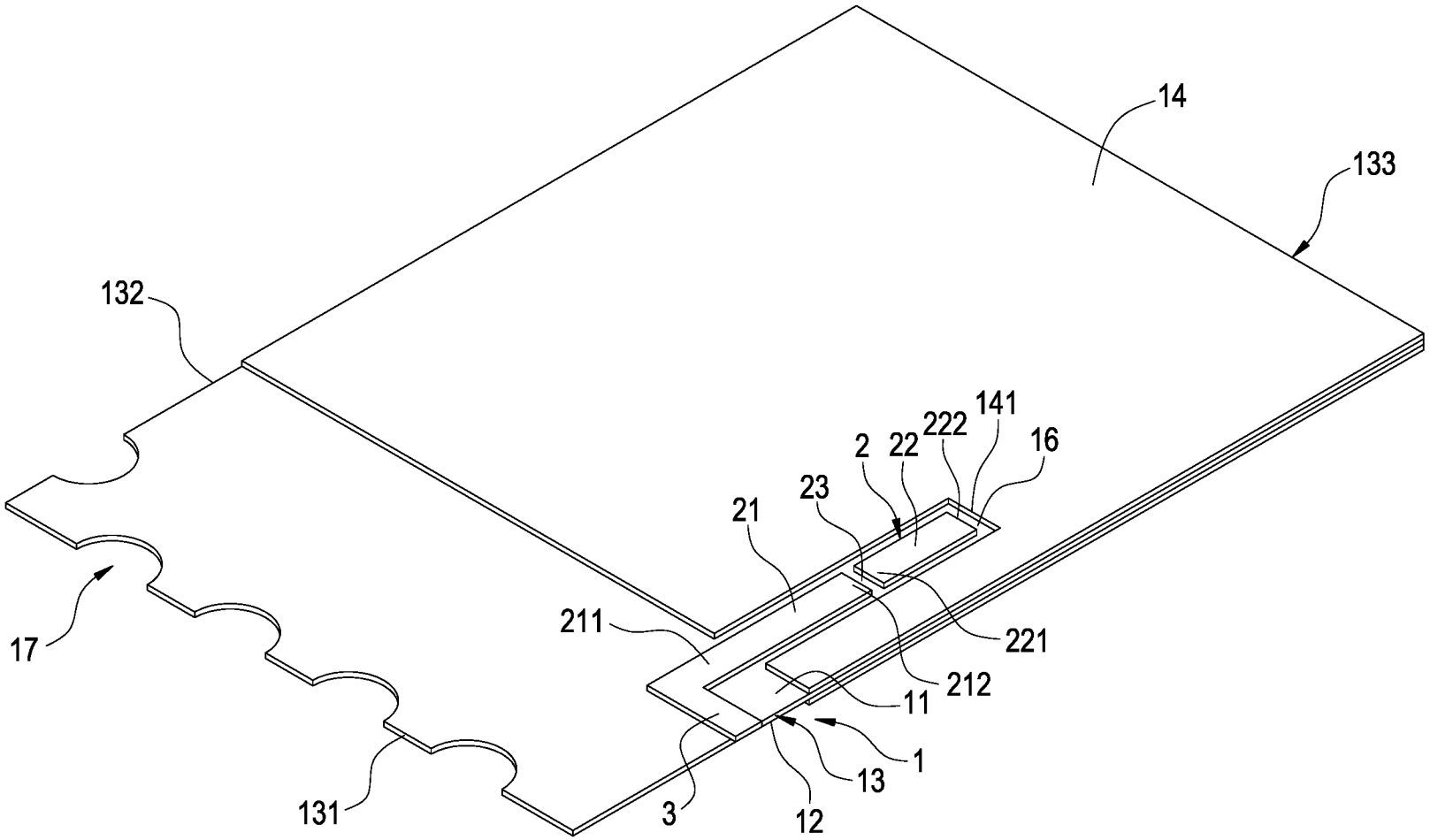
FIG. 12 shows the enhanced printed circuit board monopole antenna without the second-radiation unit of the second embodiment of the present invention.
Figure 13:
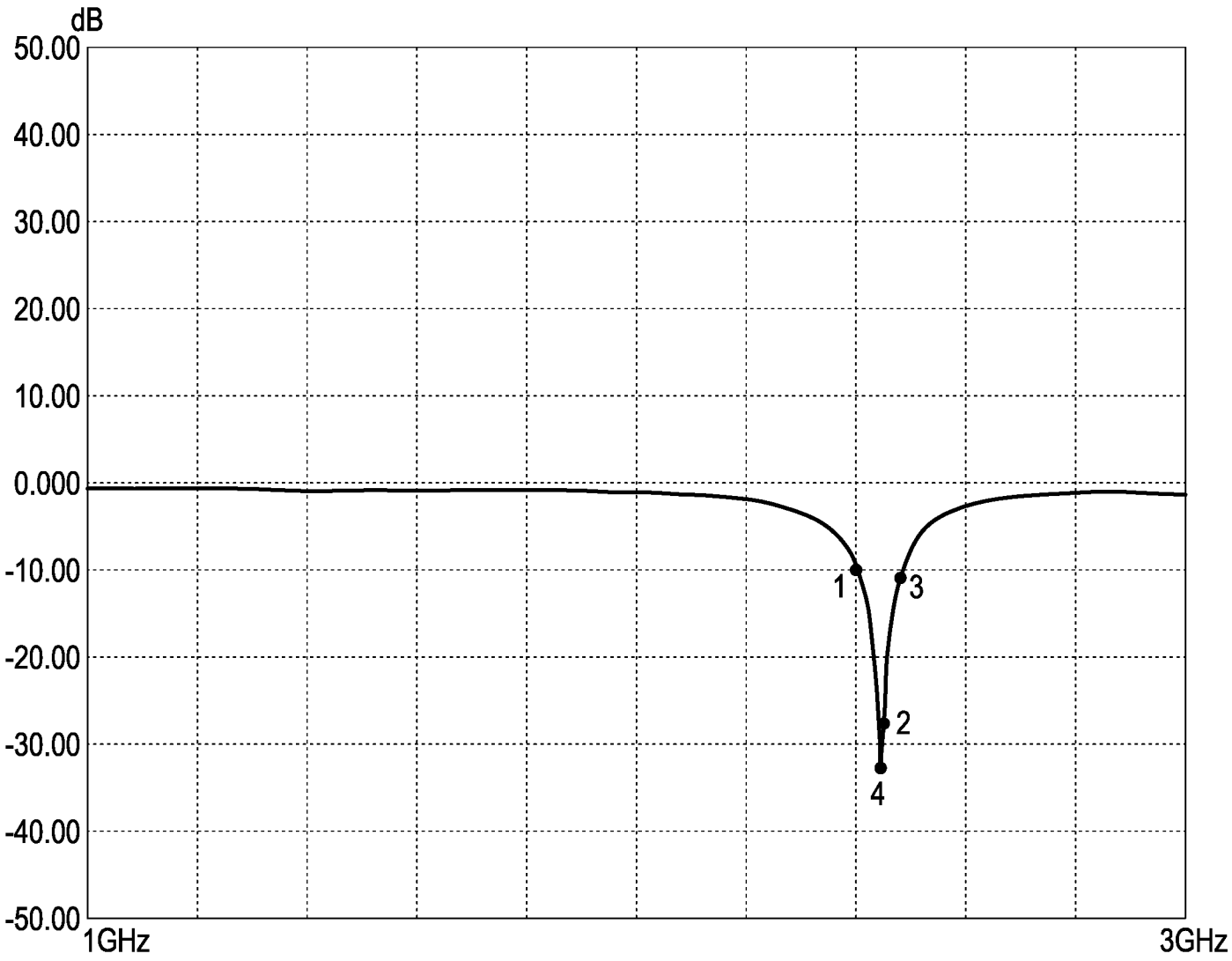
FIG. 13 shows a curve diagram of the reflection coefficient testing of the enhanced printed circuit board monopole antenna without the second-radiation unit at high frequencies of the second embodiment of the present invention.

FIG. 12 shows the enhanced printed circuit board monopole antenna without the second-radiation unit of the second embodiment of the present invention. FIG. 13 shows a curve diagram of the reflection coefficient testing of the enhanced printed circuit board monopole antenna without the second-radiation unit at high frequencies of the second embodiment of the present invention. As shown in FIG. 13, when the enhanced printed circuit board monopole antenna without the second-radiation unit 4 is used, at frequency 2.400 GHZ is −9.5884 dB, at frequency 2.450 GHZ is −27.729 dB, at frequency 2.483 GHZ is −10.565 dB and at frequency 2.44625 GHZ is −32.961 dB. Therefore, for the design without the second-radiation unit 4, the first-radiation unit 3 cannot control 88 MHZ-60 GHZ frequency range to achieve the predetermined target impedance, resonant frequency, bandwidth and radiation efficiency. The antenna radiation efficiency cannot be increased efficiently, either.

Figure 14:
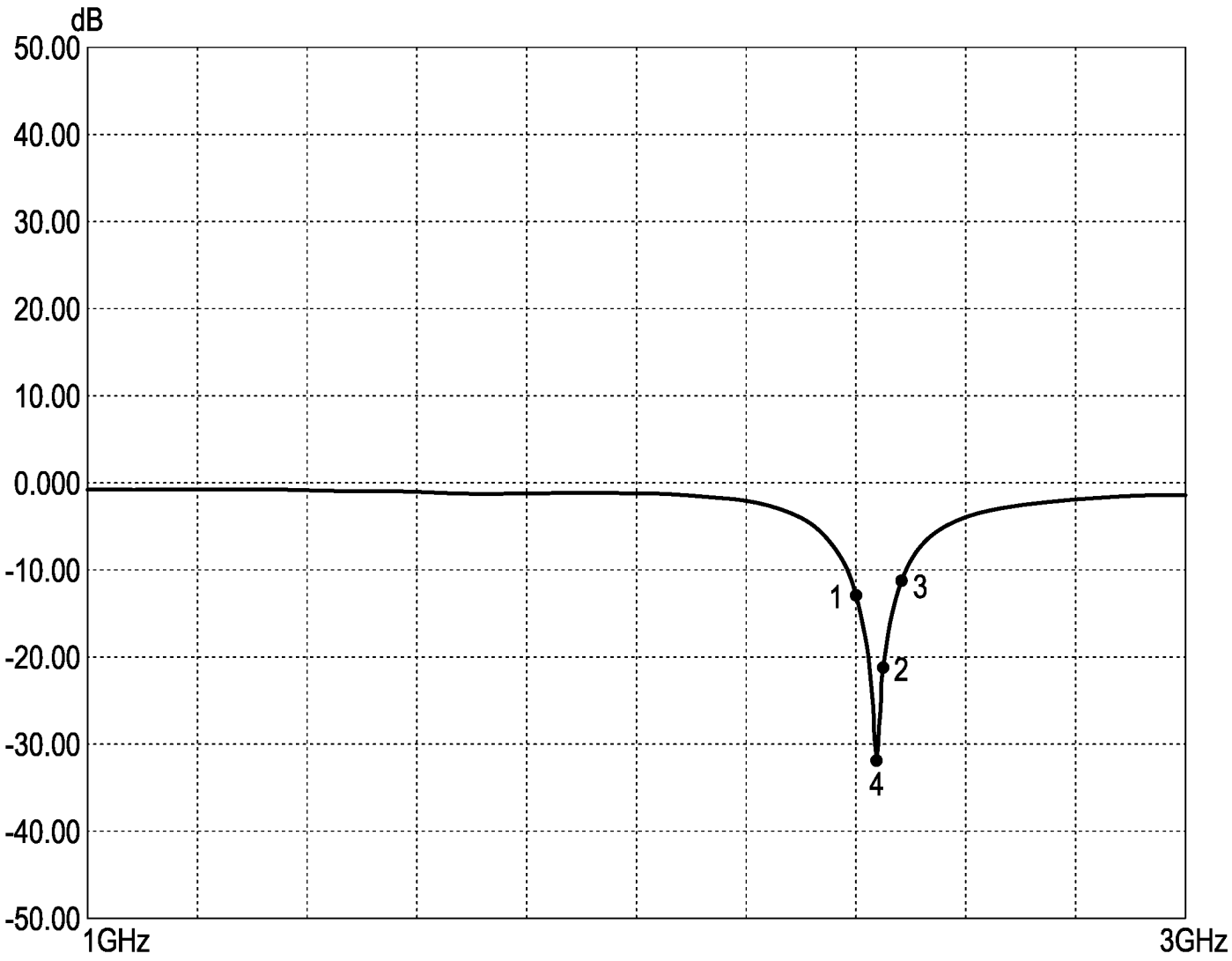
FIG. 14 shows a curve diagram of the reflection coefficient testing of the enhanced printed circuit board monopole antenna with the second-radiation unit at high frequencies of the first embodiment of the present invention.

FIG. 14 shows a curve diagram of the reflection coefficient testing of the enhanced printed circuit board monopole antenna with the second-radiation unit at high frequencies of the first embodiment of the present invention. Please refer to FIG. 11 at the same time. As shown in FIG. 14, when the enhanced printed circuit board monopole antenna with the second-radiation unit 4 is used, at frequency 2.400 GHZ is −13.439 dB, at frequency 2.450 GHZ is −20.936 dB, at frequency 2.483 GHZ is −11.216 dB and at frequency 2.4436250 GHZ is −32.105 dB. Therefore, according to the frequency wave length (1λ, ½λ, ¼λ or ⅛λ) formed by the first-radiation unit 3 and the second-radiation unit 4 cooperating with each other, the present invention controls 88 MHZ-60 GHZ frequency range to achieve the predetermined target impedance, resonant frequency, bandwidth and radiation efficiency. The antenna radiation efficiency can be increased effectively.

Figure 15:
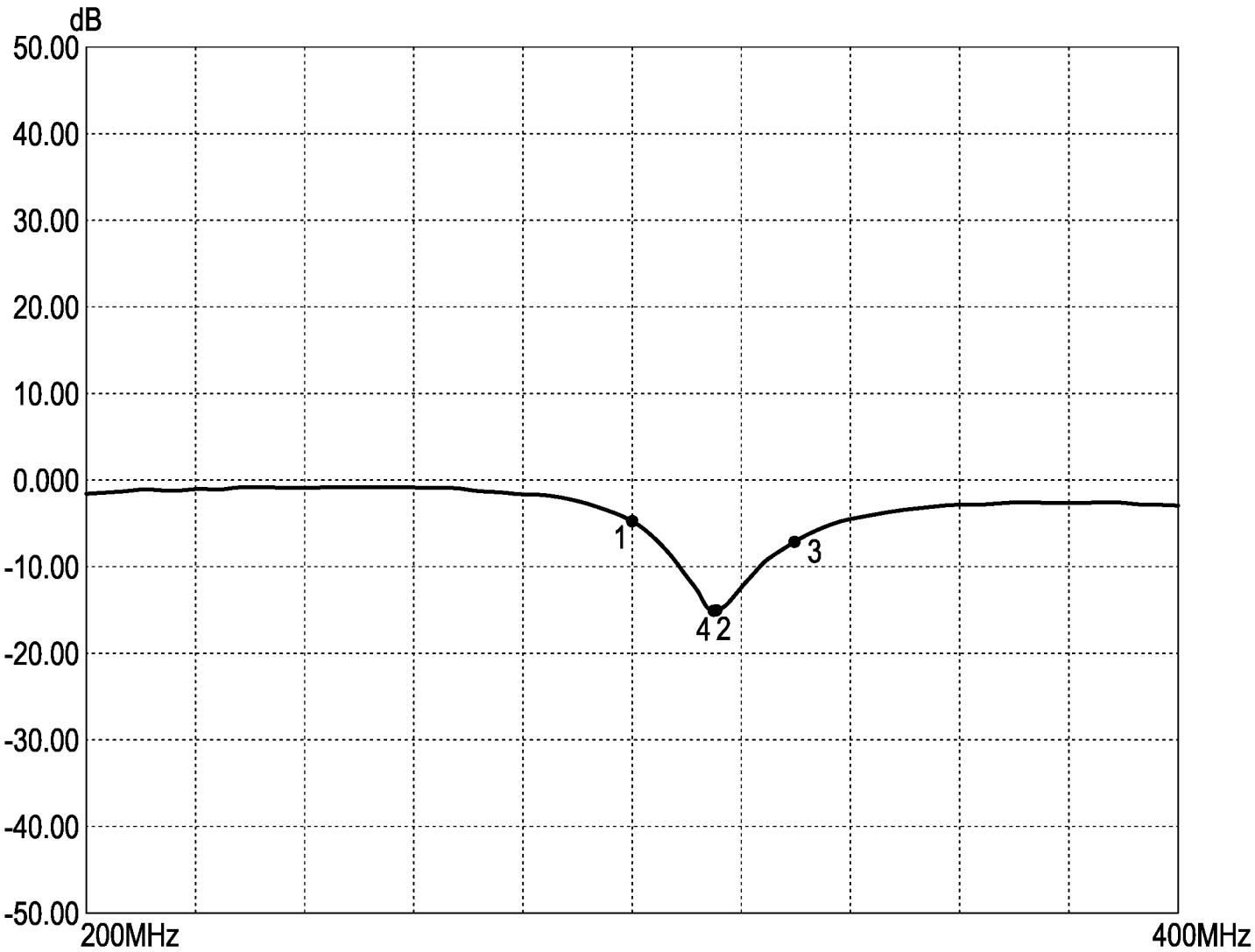
FIG. 15 shows a curve diagram of the reflection coefficient testing of the enhanced printed circuit board monopole antenna without the second-radiation unit at low frequencies of the second embodiment of the present invention.

FIG. 12 shows the enhanced printed circuit board monopole antenna without the second-radiation unit of the second embodiment of the present invention. FIG. 15 shows a curve diagram of the reflection coefficient testing of the enhanced printed circuit board monopole antenna without the second-radiation unit at low frequencies of the second embodiment of the present invention. As shown in FIG. 15, when the enhanced printed circuit board monopole antenna without the second-radiation unit 4 is used, at frequency 300.00000 MHZ is −5.0154 dB, at frequency 315.00000 MHZ is −15.262 dB, at frequency 330.00000 MHZ is −7.3123 dB and at frequency 315.00000 MHZ is −15.333 dB. Therefore, for the design without the second-radiation unit 4, the first-radiation unit 3 cannot control 88 MHZ-60 GHZ frequency range to achieve the predetermined target impedance, resonant frequency, bandwidth and radiation efficiency. The antenna radiation efficiency cannot be increased efficiently, either.

Figure 16:
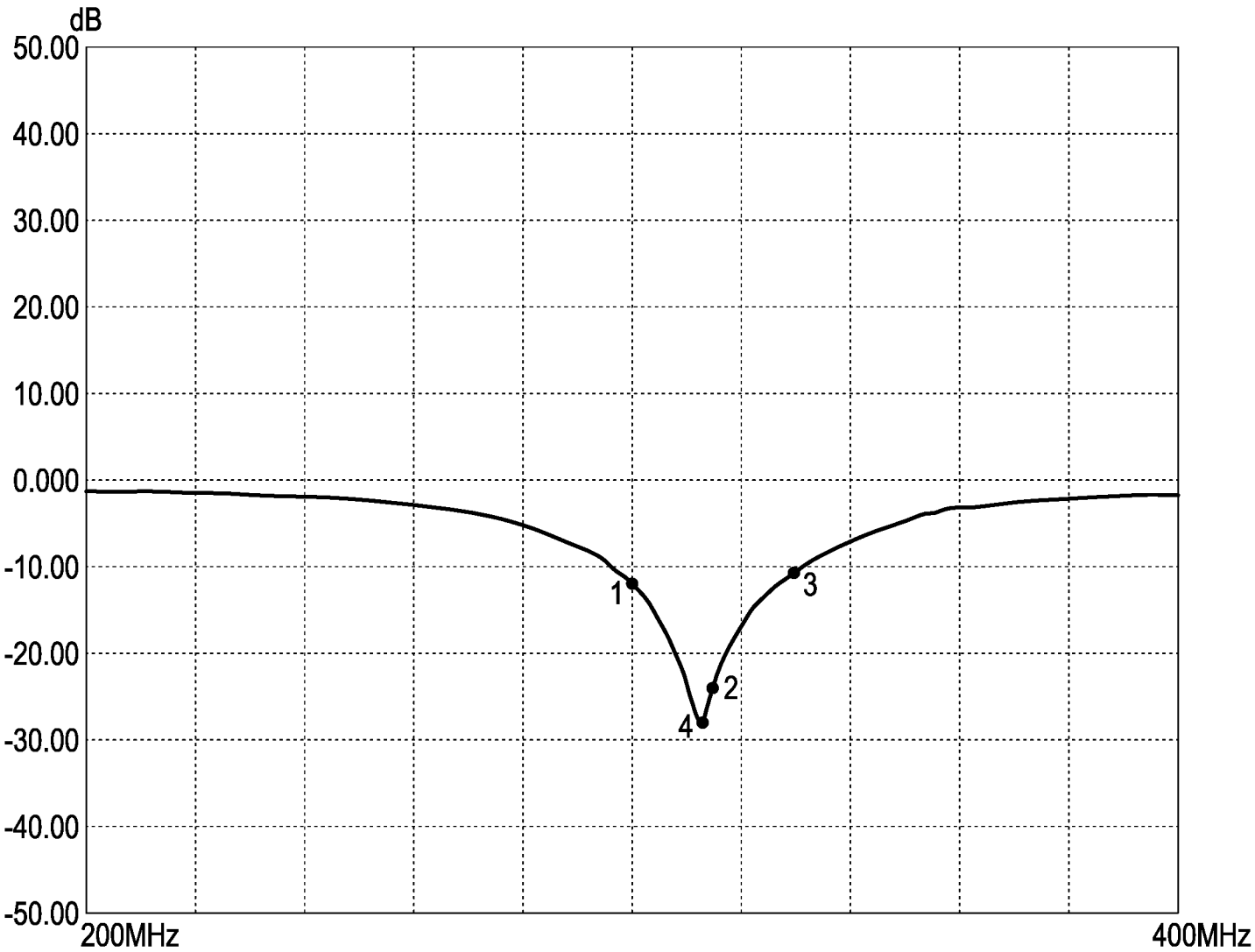
FIG. 16 shows a curve diagram of the reflection coefficient testing of the enhanced printed circuit board monopole antenna with the second-radiation unit at low frequencies of the second embodiment of the present invention.

FIG. 16 shows a curve diagram of the reflection coefficient testing of the enhanced printed circuit board monopole antenna with the second-radiation unit at low frequencies of the second embodiment of the present invention. Please refer to FIG. 11 at the same time. As shown in FIG. 16, when the enhanced printed circuit board monopole antenna with the second-radiation unit 4 is used, at frequency 300.00000 MHZ is −12.218 dB, at frequency 315.00000 MHZ is −24.314 dB, at frequency 330.00000 MHZ is −10.748 dB and at frequency 313.00000 MHZ is −28.078 dB. Therefore, according to the frequency wave length (1λ, ½λ, ¼λ or ⅛λ) formed by the first-radiation unit 3 and the second-radiation unit 4 cooperating with each other, the present invention controls 88 MHZ-60 GHZ frequency range to achieve the predetermined target impedance, resonant frequency, bandwidth and radiation efficiency. The antenna radiation efficiency can be increased effectively.

Figure 17:
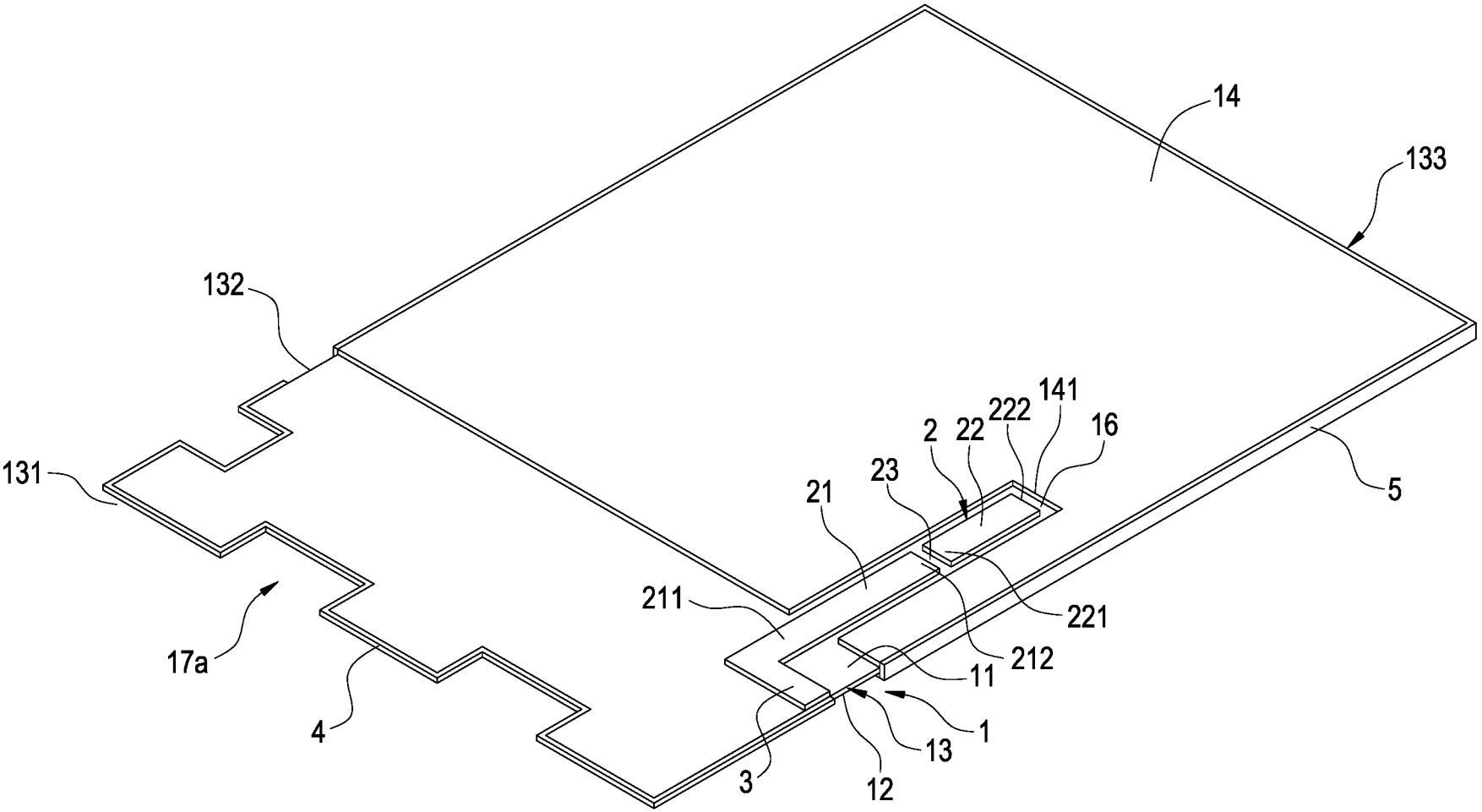
FIG. 17 shows a front view of the enhanced printed circuit board monopole antenna of the third embodiment of the present invention.

FIG. 17 shows a front view of the enhanced printed circuit board monopole antenna of the third embodiment of the present invention. As shown in FIG. 17, the third embodiment is much the same with the first embodiment. The differences are that a plurality of breaches 17*a* in square shapes adjacent to each other are arranged at the edge front side 131 and the edge aside side 132 of the baseplate 1. Namely, the enhanced printed circuit board monopole antenna of the present invention further comprises the breaches 17*a*. The second-radiation unit 4 is arranged on the front side 11 of the baseplate 1, the edge front side 131, the edge aside side 132 and the breaches 17*a* at the edge front side 131 and the edge aside side 132, and is electrically connected to the first-radiation unit 3.

Figure 18:
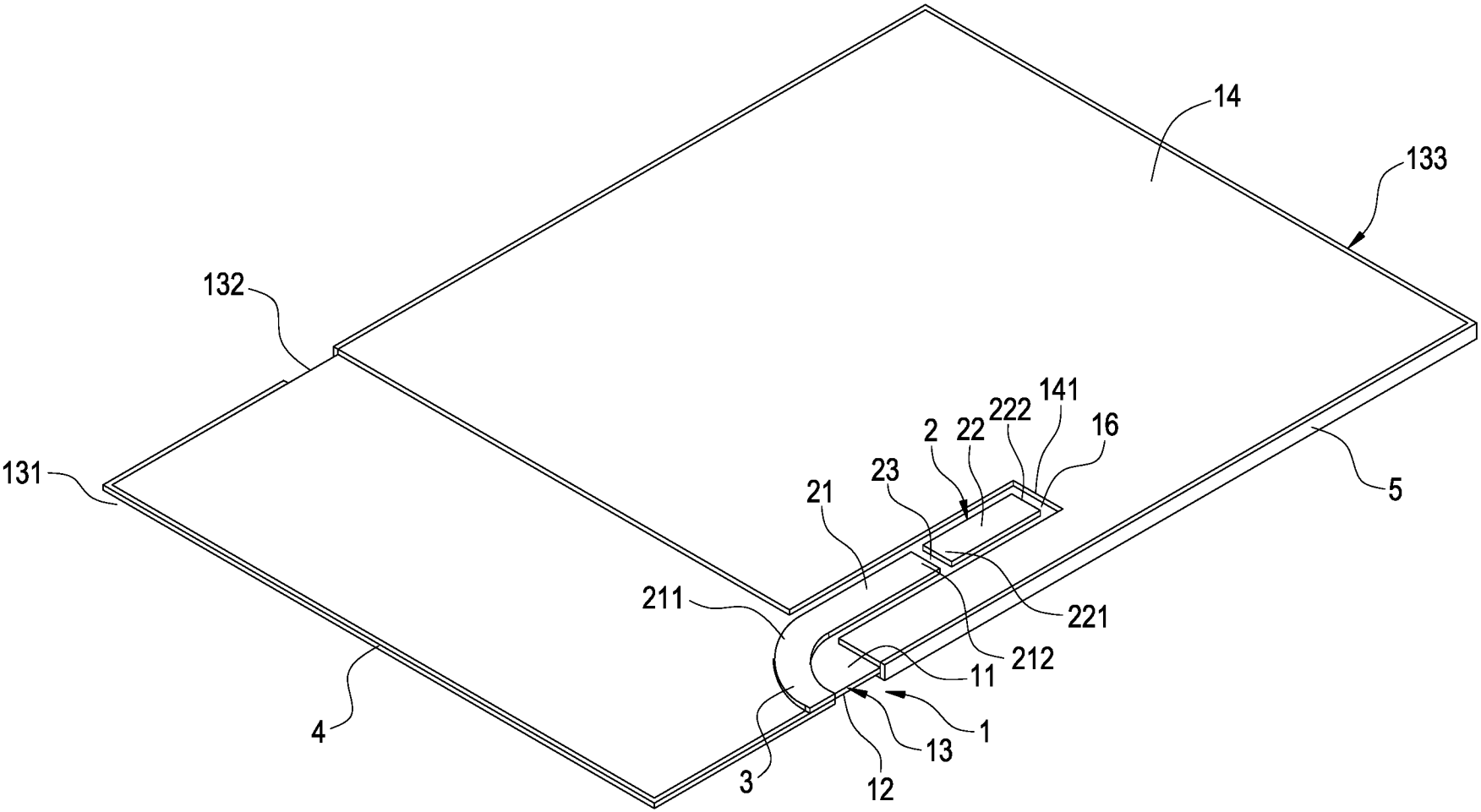
FIG. 18 shows a front view of the enhanced printed circuit board monopole antenna of the fourth embodiment of the present invention.

FIG. 18 shows a front view of the enhanced printed circuit board monopole antenna of the fourth embodiment of the present invention. As shown in FIG. 18, the fourth embodiment is much the same with the first embodiment. The differences are that the edge front side 131 of the baseplate 1 is paralleled, for example but not limited to, to the edge back side 133. The second-radiation unit 4 is arranged on the front side 11 of the baseplate 1, the edge front side 131 and the edge aside side 132, and is electrically connected to the first-radiation unit 3.

Figure 19:
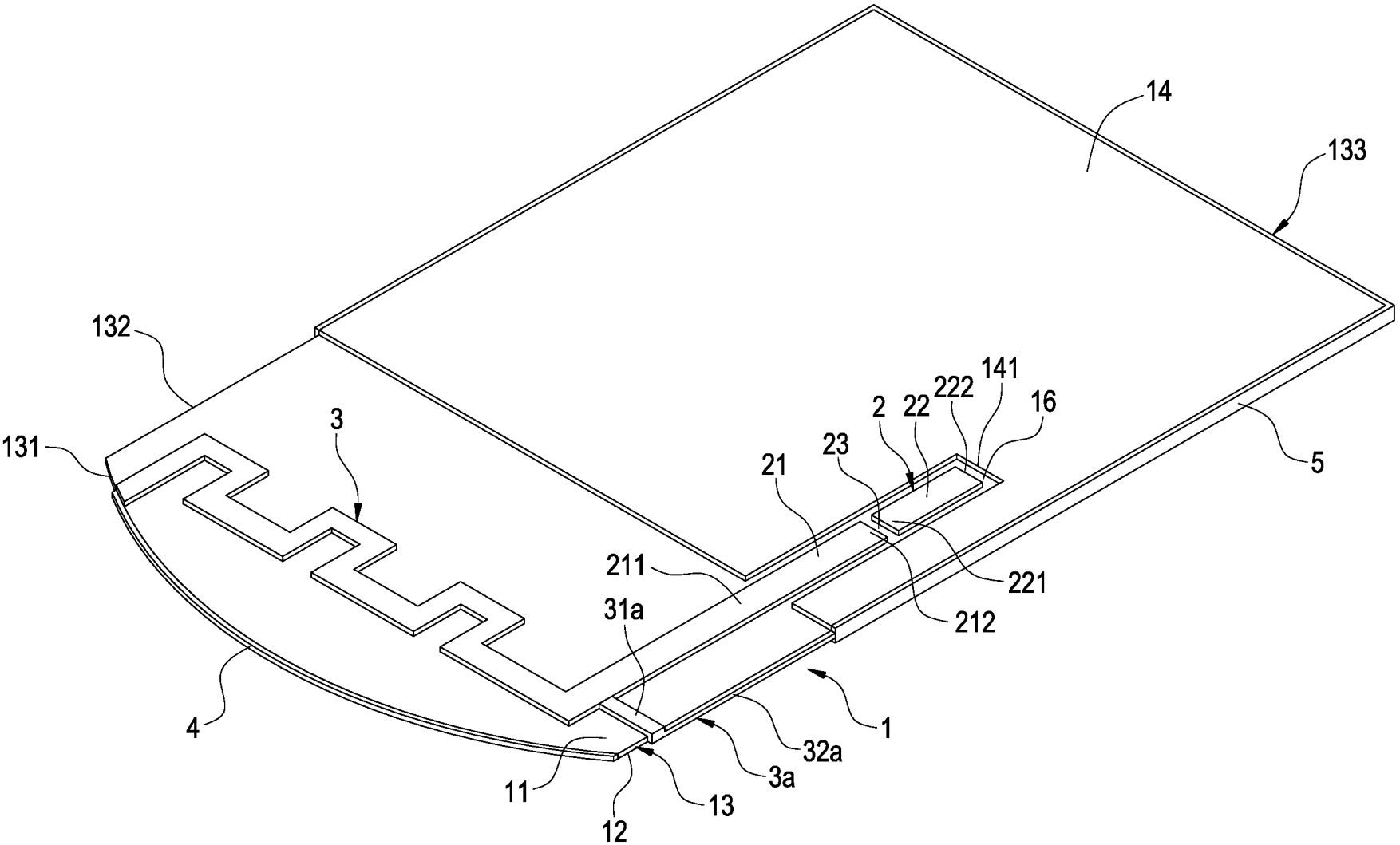
FIG. 19 shows a front view of the enhanced printed circuit board monopole antenna of the fifth embodiment of the present invention.

FIG. 19 shows a front view of the enhanced printed circuit board monopole antenna of the fifth embodiment of the present invention. As shown in FIG. 19, the embodiment is much the same with the first embodiment. The differences are that an auxiliary-radiation unit 3*a* in an L shape is extended from one side of the first-radiation unit 3. Namely, the enhanced printed circuit board monopole antenna of the present invention further comprises the auxiliary-radiation unit 3*a*. The auxiliary-radiation unit 3*a* comprises a first auxiliary-radiation line 31*a* and a second auxiliary-radiation line 32*a*. One side of the first auxiliary-radiation line 31*a* is electrically connected to the first-radiation unit 3. The other side of the first auxiliary-radiation line 31*a* is extended to the edge aside side 132. The second auxiliary-radiation line 32*a* is arranged on the edge aside side 132 and is electrically connected to the first auxiliary-radiation line 31*a*. The auxiliary-radiation unit 3*a* renders that the radiation efficiency of the first-radiation unit 3 is increased.

Figure 20:
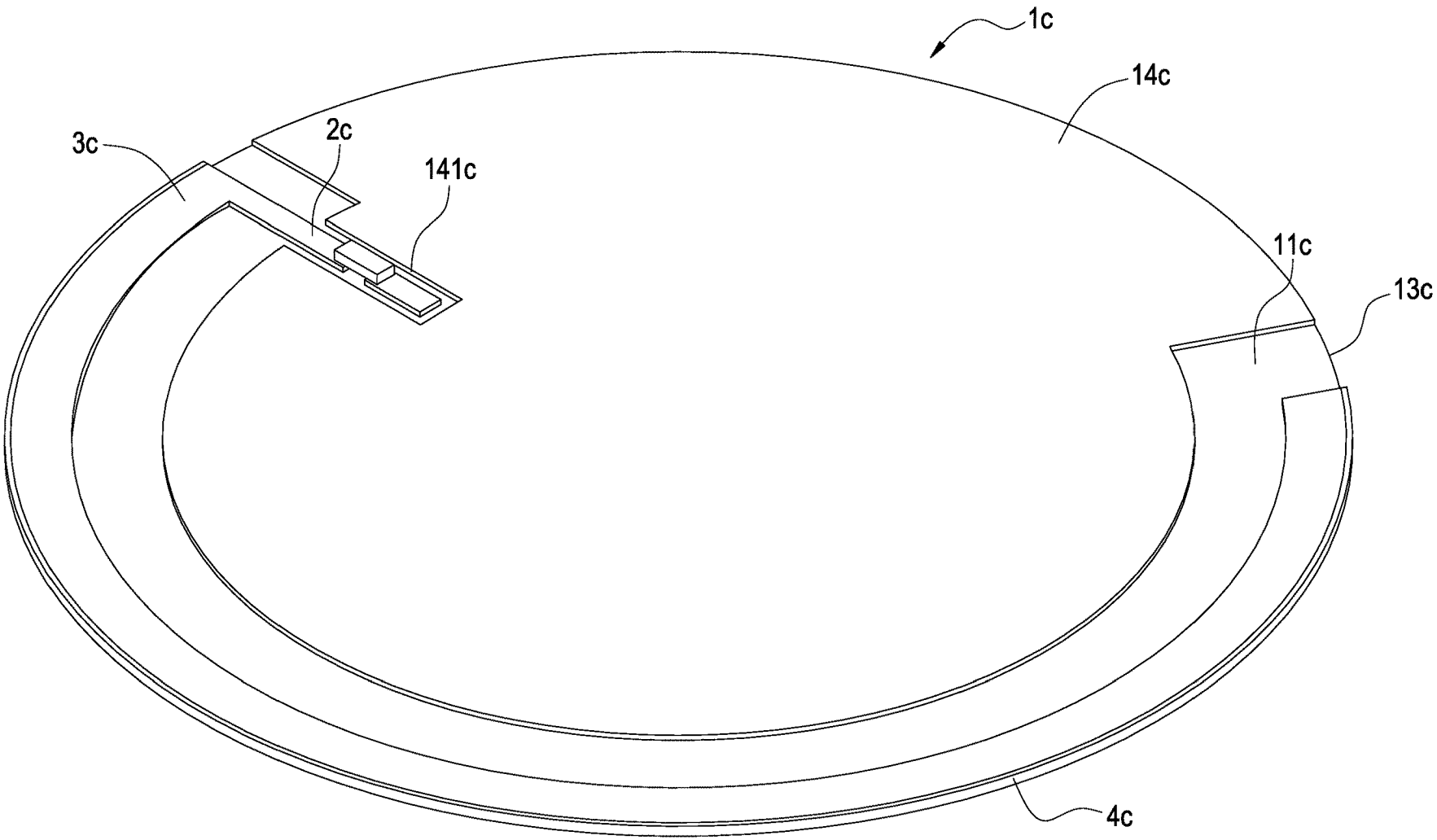
FIG. 20 shows a top view of the enhanced printed circuit board monopole antenna of the sixth embodiment of the present invention.
Figure 21:
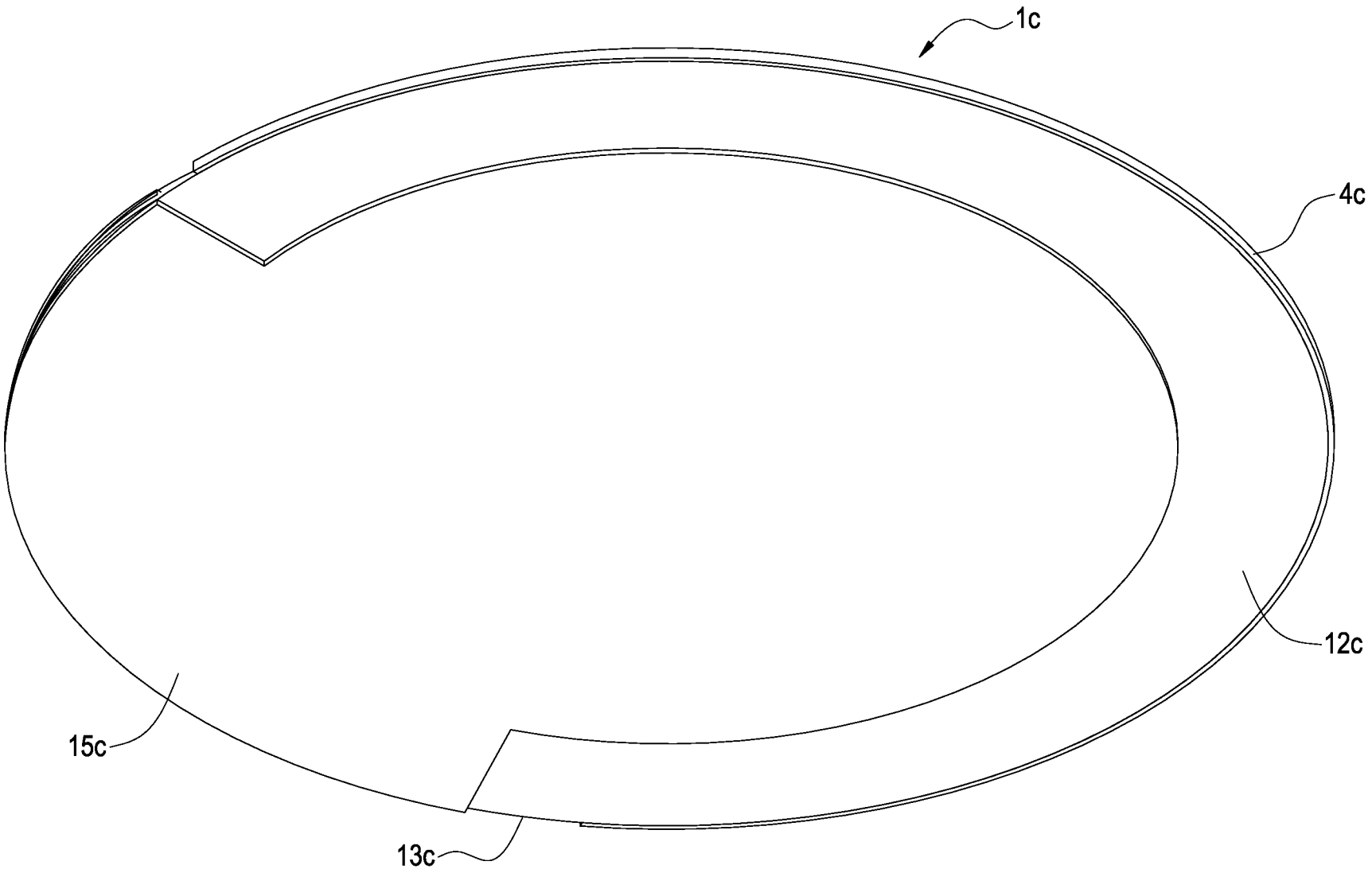
FIG. 21 shows a bottom view of the enhanced printed circuit board monopole antenna of the sixth embodiment of the present invention.
Figure 22:
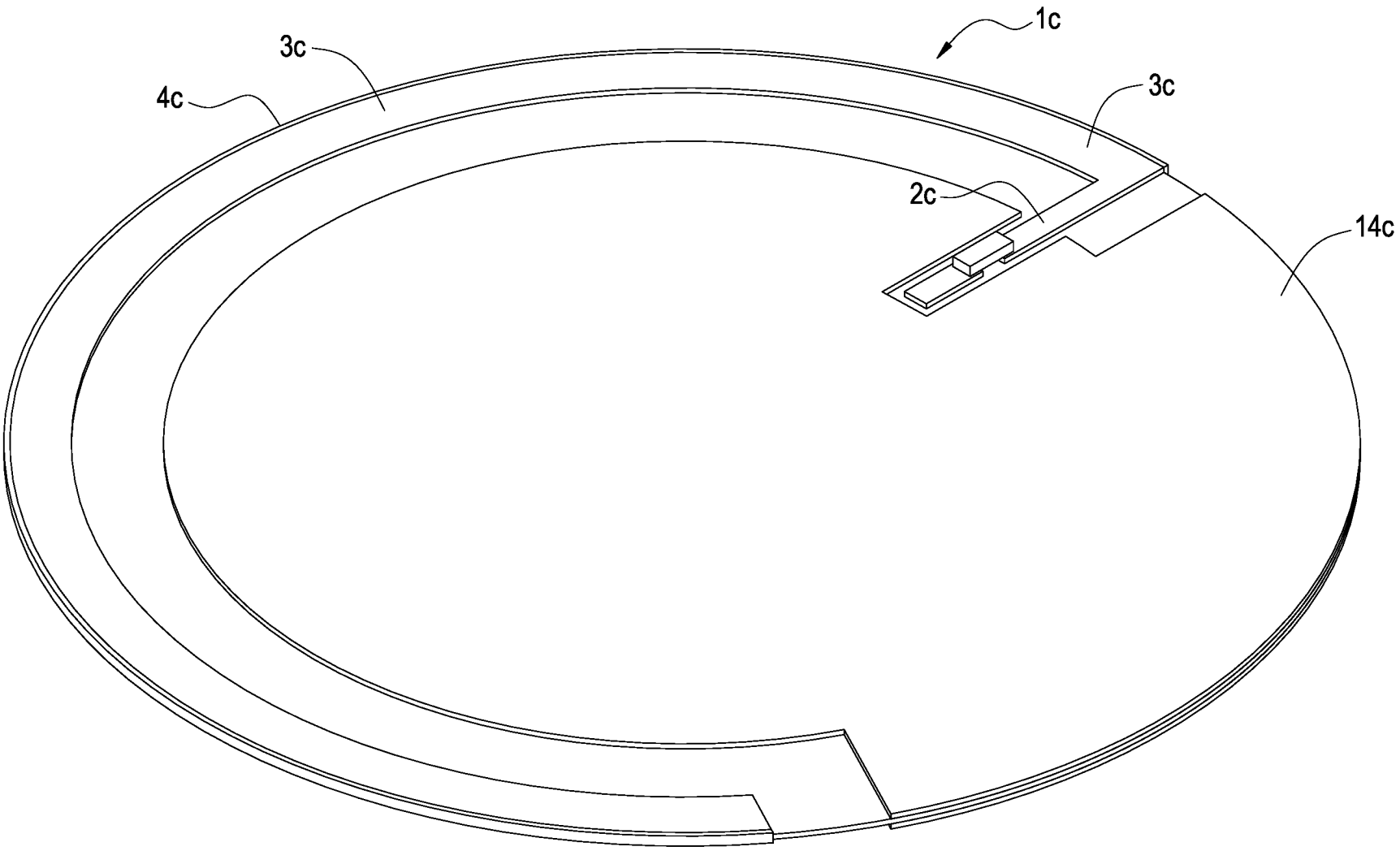
FIG. 22 shows a side view of the enhanced printed circuit board monopole antenna of the sixth embodiment of the present invention.
Figure 23:
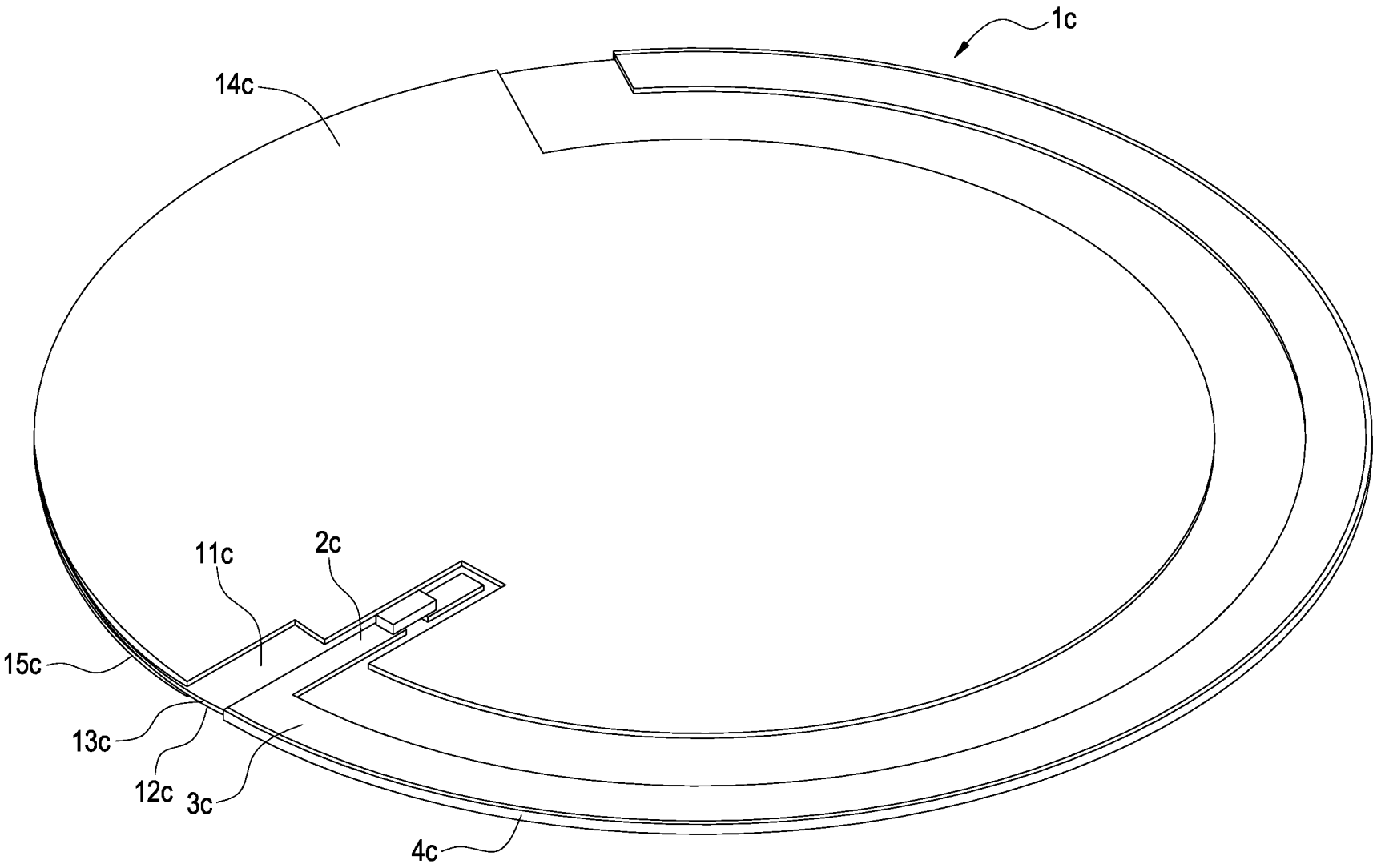
FIG. 23 shows another side view of the enhanced printed circuit board monopole antenna of the sixth embodiment of the present invention.

FIG. 20 shows a top view of the enhanced printed circuit board monopole antenna of the sixth embodiment of the present invention. FIG. 21 shows a bottom view of the enhanced printed circuit board monopole antenna of the sixth embodiment of the present invention. FIG. 22 shows a side view of the enhanced printed circuit board monopole antenna of the sixth embodiment of the present invention. FIG. 23 shows another side view of the enhanced printed circuit board monopole antenna of the sixth embodiment of the present invention. As shown in the figures, the embodiment is much the same with the first embodiment. The differences are that the embodiment of the present invention has a circle baseplate 1*c*. The circle baseplate 1*c* comprises a front side 11*c*, a back side 12*c* and a periphery side 13*c*. A first ground unit 14*c* is arranged on the front side 11*c*. The first ground unit 14*c* comprises a circle pattern layer and a fan-shaped pattern layer, wherein an area of the circle pattern layer and the fan-shaped pattern layer is less than an area of the front side 11*c* of the circle baseplate 1*c*. The fan-shaped pattern layer is extended to an edge of the front side 11*c*. A second ground unit 15*c* having the same shape with the first ground unit 14*c* and corresponding to the first ground unit 14*c* is arranged on the back side 12*c*. An opening 141*c* in a U shape is arranged on the first ground unit 14*c*. A signal feed-in unit 2*c* is arranged on the opening 141*c*. The signal feed-in unit 2*c* is electrically connected to a first-radiation unit 3*c*. The first-radiation unit 3*c* is arranged on the front side 11*c* of the circle baseplate 1*c* and has a specific length arranged along an edge of the front side 11*c* of the circle baseplate 1*c*. A second-radiation unit 4*c* is arranged on the periphery side 13*c* and is electrically connected to the first-radiation unit 3*c*. A specific length of the second-radiation unit 4*c* is 5~300 mm. Namely, the enhanced printed circuit board monopole antenna of the present invention further comprises the first ground unit 14*c*, the second ground unit 15*c*, the opening 141*c*, the signal feed-in unit 2*c*, the first-radiation unit 3*c* and the second-radiation unit 4*c*.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An enhanced printed circuit board monopole antenna comprising:

a circle baseplate comprising a front side, a back side and a periphery side, wherein a first ground unit is arranged on the front side, the first ground unit comprises a circle pattern layer and a fan-shaped pattern layer, an area of the circle pattern layer and the fan-shaped pattern layer is less than an area of the front side of the circle baseplate, the fan-shaped pattern layer is extended to an edge of the front side, and a second ground unit having the same shape with the first ground unit and corresponding to the first ground unit is arranged on the back side;

a signal feed-in unit arranged on the front side of the circle baseplate, wherein a spacing is between the signal feed-in unit and the first ground unit;

a first-radiation unit arranged on the front side of the circle baseplate and arranged at one side of the first ground unit and electrically connected to the signal feed-in unit and having a specific length arranged along an edge of the front side of the circle baseplate; and a second-radiation unit arranged on the periphery side of the circle baseplate and electrically connected to the first-radiation unit.

2. The enhanced printed circuit board monopole antenna in claim 1, wherein an opening in a u shape is arranged on the first ground unit; the spacing is between the opening and the signal feed-in unit.

3. The enhanced printed circuit board monopole antenna in claim 1, wherein the signal feed-in unit comprises a first signal feed-in line and a second signal feed-in line; the first signal feed-in line comprises a first endpoint and a second endpoint; the second signal feed-in line comprises a third endpoint and a fourth endpoint; a gap is between the second endpoint and the third endpoint.

4. The enhanced printed circuit board monopole antenna in claim 3, wherein the gap and the spacing form a matching circuit, or a coupling component or an inductance component is electrically connected to between the second endpoint and the third endpoint.

5. The enhanced printed circuit board monopole antenna in claim 4, wherein a specific length of the second-radiation unit is 5~300 mm.

* * * * *